US008295977B2

(12) United States Patent
Yuyama et al.

(10) Patent No.: US 8,295,977 B2
(45) Date of Patent: Oct. 23, 2012

(54) MEDICINE DISPENSER

(75) Inventors: Hiroyuki Yuyama, Osaka (JP); Yoshinori Kumano, Osaka (JP); Tasuku Minami, Osaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 612 days.

(21) Appl. No.: 12/064,740

(22) PCT Filed: Aug. 23, 2006
(Under 37 CFR 1.47)

(86) PCT No.: PCT/JP2006/316448

§ 371 (c)(1),
(2), (4) Date: Jun. 2, 2009

(87) PCT Pub. No.: WO2007/023829

PCT Pub. Date: Mar. 1, 2007

(65) Prior Publication Data

US 2009/0294467 A1 Dec. 3, 2009

(30) Foreign Application Priority Data

Aug. 25, 2005 (JP) ..... 2005-244942

(51) Int. Cl.
*G06F 17/00* (2006.01)

(52) U.S. Cl. ..... 700/236; 700/242; 700/244

(58) Field of Classification Search ..... 700/236, 700/242, 244
See application file for complete search history.

(56) References Cited

U.S. PATENT DOCUMENTS 5,337,919 A 8/1994 Spaulding et al.
5,671,592 A 9/1997 Yuyama et al.
5,720,154 A 2/1998 Lasher et al.
5,771,657 A 6/1998 Lasher et al.
5,930,145 A 7/1999 Yuyama et al.
5,963,453 A 10/1999 East
6,006,946 A 12/1999 Williams et al.
6,119,737 A 9/2000 Yuyama et al.
(Continued)

FOREIGN PATENT DOCUMENTS

EP 1 433 457 A1 6/2004
(Continued)

OTHER PUBLICATIONS

U.S. Appl. No. 12/729,850, filed Mar. 23, 2010, Yuyama et al.
(Continued)

*Primary Examiner* — Timothy Waggoner
(74) *Attorney, Agent, or Firm* — Patterson Thuente Christensen Pedersen, P.A.

(57) ABSTRACT

(Object) To enable, in an operation of supplying a medicine to a medicine cassette, in which it is typical that the medicine once put in a vial bottle is recovered to a medicine cassette (medicine receiving container), an operation of specifying the medicine cassette to which the medicine is to be supplied to be performed more accurately and more efficiently.

(Solving Means) Information used for specifying the medicine is read by reading a prescription code (d31) recorded as a bar code on a vial bottle (S202) or is input as search information through an operation portion (S221). As a result, a cassette shelf (2) (cassette code (d21)) to which a medicine cassette (1) for receiving the medicine corresponding to the input information is mounted is specified (S203, S224), and a shelf lamp (3) provided to the specified cassette shelf (2) is brought into a predetermined notification display state (blinking state).

23 Claims, 8 Drawing Sheets

U.S. PATENT DOCUMENTS

| | | | | |
|---|---|---|---|---|
| 6,202,923 | B1 | 3/2001 | Boyer et al. | |
| 6,349,848 | B1 * | 2/2002 | Uema et al. | 221/21 |
| 6,625,952 | B1 | 9/2003 | Chudy et al. | |
| 6,644,504 | B2 * | 11/2003 | Yuyama et al. | 221/264 |
| 6,684,126 | B2 | 1/2004 | Omura et al. | |
| 6,739,476 | B2 | 5/2004 | Shigeyama et al. | |
| 6,742,671 | B2 | 6/2004 | Hebron et al. | |
| 6,748,295 | B2 | 6/2004 | Tilles et al. | |
| 7,080,755 | B2 * | 7/2006 | Handfield et al. | 700/237 |
| 7,086,650 | B2 | 8/2006 | Fujiwara et al. | |
| 7,234,609 | B2 | 6/2007 | DeLazzer et al. | |
| 7,263,411 | B2 * | 8/2007 | Shows et al. | 700/237 |
| 7,434,704 | B2 | 10/2008 | Yuyama et al. | |
| 7,562,791 | B2 | 7/2009 | Yuyama et al. | |
| 7,630,908 | B1 | 12/2009 | Amrien et al. | |
| 7,801,642 | B2 | 9/2010 | Ansari et al. | |
| 7,861,492 | B2 | 1/2011 | Yuyama et al. | |
| 2002/0143429 | A1 | 10/2002 | Yuyama et al. | |
| 2003/0074868 | A1 | 4/2003 | Yasuoka et al. | |
| 2003/0187692 | A1 | 10/2003 | Park | |
| 2004/0017475 | A1 | 1/2004 | Akers et al. | |
| 2004/0039481 | A1 | 2/2004 | De La Huerga | |
| 2004/0045977 | A1 | 3/2004 | William et al. | |
| 2004/0134043 | A1 | 7/2004 | Uema et al. | |
| 2005/0131578 | A1 | 6/2005 | Weaver | |
| 2005/0240441 | A1 | 10/2005 | Suzuki et al. | |
| 2007/0129911 | A1 | 6/2007 | Yuyama et al. | |
| 2007/0150092 | A1 | 6/2007 | Ohmura et al. | |
| 2008/0017661 | A1 | 1/2008 | Hutchinson et al. | |
| 2008/0271414 | A1 | 11/2008 | Yuyama et al. | |
| 2009/0204255 | A1 | 8/2009 | Yuyama et al. | |
| 2010/0175782 | A1 | 7/2010 | Yuyama et al. | |

FOREIGN PATENT DOCUMENTS

| | | | |
|---|---|---|---|
| JP | 02-083186 | | 3/1990 |
| JP | 03-242147 | | 10/1991 |
| JP | 06-316312 | A | 11/1994 |
| JP | 08-007014 | A | 1/1996 |
| JP | 09-034942 | A | 2/1997 |
| JP | 10-077107 | | 3/1998 |
| JP | 11-070901 | | 3/1999 |
| JP | 11-208604 | | 8/1999 |
| JP | 2001-306688 | A | 11/2001 |
| JP | 2002-120913 | | 4/2002 |
| JP | 2002-126044 | | 5/2002 |
| JP | 2002-514152 | | 5/2002 |
| JP | 2002-272812 | | 9/2002 |
| JP | 2002-272814 | A | 9/2002 |
| JP | 2002-370701 | | 12/2002 |
| JP | 2003-044940 | | 2/2003 |
| JP | 2003-099534 | A | 4/2003 |
| JP | 2003-118816 | | 4/2003 |
| JP | 2003-146414 | | 5/2003 |
| JP | 2003-206024 | | 7/2003 |
| JP | 2003-237703 | | 8/2003 |
| JP | 2003-237711 | | 8/2003 |
| JP | 2003-284760 | A1 | 10/2003 |
| JP | 2003-530650 | | 10/2003 |
| JP | 2004-000429 | A | 1/2004 |
| JP | 2004-103001 | A | 4/2004 |
| JP | 2004-157579 | | 6/2004 |
| JP | 2004-187958 | | 7/2004 |
| JP | 2004-256242 | | 9/2004 |
| JP | 2004-348717 | A | 12/2004 |
| JP | 2005-122360 | | 5/2005 |
| JP | 2005-140763 | A | 6/2005 |
| JP | 2005-192702 | | 7/2005 |
| WO | WO 99/29467 | | 6/1999 |
| WO | WO 01/77927 | | 10/2001 |
| WO | WO 2004/014288 | | 2/2004 |
| WO | WO 2004/014734 | | 2/2004 |

OTHER PUBLICATIONS

U.S. Appl. No. 12/729,850.

International Search Report for International Application No. PCT/JP2006/302152 dated Jun. 13, 2006.

Application and File History of U.S. Appl. No. 11/887,029, filed Apr. 21, 2009, inventors Yuyama et al.

Application and File History of U.S. Appl. No. 11/884,333, filed Aug. 14, 2007, inventors Yuyuma et al.

Application and File History of U.S. Appl. No. 12/729,850, filed Mar. 23, 2010, inventors Yuyama et al.

* cited by examiner

FIG. 6

(a) MEDICINE MASTER DB (d1)

| | | |
|---|---|---|
| d11 | NDC | NATIONAL DRUG CODE : MEDICINE CODE |
| d12 | MEDICINE NAME | |
| d13 | QUANTITY UNIT | SHEET, CAP, TABLET, ··· |
| d14 | MODE | EXTERNAL USE/PATCH, ···, CAPSULE, TABLET, ··· |
| d15 | USAGE INFORMATION | THREE TIMES PER DAY ONE TABLET AFTER EACH OF BREAKFAST, LUNCH, AND DINNER, ··· |
| d16 | APPEARANCE PHOTOGRAPH DATA | |
| d17 | SHAPE | DISK SHAPE, SPHERICAL SHAPE, ··· |
| d18 | DIMENSION | MAXIMUM LENGTH (mm) |
| d19 | COLOR | |

⋮

(b) CASSETTE DB (d2)

| | |
|---|---|
| d21 | CASSETTE CODE |
| d11 | NDC |
| d22 | REMAINING AMOUNT |

⋮

(c) PRESCRIPTION DATA (d3)

| | |
|---|---|
| d31 | PRESCRIPTION CODE |
| d11 | NDC |
| d12 | MEDICINE NAME |
| d32 | PRESCRIBED QUANTITY |
| d33 | CONTAINER SIZE |
| d34 | LABEL PRINTING INFORMATION |

⋮

(d) DISPENSING HISTORY DB (d4)

| | |
|---|---|
| d41 | DISPENSING DATE AND TIME |
| d31 | PRESCRIPTION CODE |
| d11 | NDC |
| d21 | CASSETTE CODE |
| d42 | DISPENSED QUANTITY |
| d43 | EXPIRATION DATE |

⋮

(e) MEDICINE SUPPLY HISTORY DB (d5)

| | |
|---|---|
| d51 | SUPPLY DATE |
| d21 | CASSETTE CODE |
| d11 | NDC |
| d52 | SUPPLIED QUANTITY |
| d53 | EXPIRATION DATE |
| d54 | SUPPLIER |

⋮

MEDICINE DISPENSER

TECHNICAL FIELD

The present invention relates to a medicine dispensing device for dispensing a medicine of a kind and in an amount corresponding to contents of a medicine prescription for each of patients, from a plurality of medicine-receiving containers each receiving a specific medicine.

BACKGROUND ART

A medicine dispensing device (or medicine distributor) installed in a pharmacy or the like dispenses medicines separately for each prescription by filling, into each of predetermined containers called vial bottles (an example of the dispensing container), a medicine of a kind and in an amount corresponding to contents of a medicine prescription for each of patients, from each of a plurality of medicine cassettes (an example of the medicine receiving container) which are containers each receiving a specific medicine (mainly tablet). The vial bottle filled with the medicines as described above is provided to the patient. Further, the medicine dispensing device of this type normally has an information recording function for recording, on the vial bottle, various kinds of information related to the medicine prescription when the medicine is filled into the vial bottle. In general, the information recording function is a function of recording information related to the medicine prescription onto a label and affixing the label to the vial bottle. On the label, in addition to character information indicating name, usage, etc. of a medicine, information for identifying the medicine prescription (prescription identification information) is recorded as a barcode or the like.

Meanwhile, in a pharmacy or the like in the United States, in a case of providing the medicine prescribed for the patient, there is performed such an operation in which, upon an appointment of picking up the medicine made by the patient to whom the medicine is prescribed, reception of a prescription issued by a doctor, or the like, the medicines corresponding to the medicine prescription are filled into the vial bottle in advance, and after that, the vial bottle is handed over (provided) when the patient appears to pick up the medicine. Hereinafter, this operation is referred to as prior dispensing.

In a case where, although the prior dispensing is performed, the patient does not appear to pick up the medicine (vial bottle) within a predetermined period of time, in order to prevent the medicine from being wasted, the medicine is recovered from the vial bottle to the original medicine cassette. Hereinafter, this operation is called medicine recovery. Especially in the United States, the medicine recovery is performed frequently.

In the medicine recovery, erroneous selection of the medicine cassette to which the medicine is to be recovered leads to medical accidents. Accordingly, it is extremely important that the medicine be recovered to the correct medicine cassette. However, in a busy medical site, it is difficult to expect prevention of errors in the medicine recovery operation depending only on attentiveness of humans.

On the other hand, Patent Document 1 discloses a technology by which, when a medicine cassette (cell 12) is replenished with a medicine from a container (container 45) containing the medicine to be replenished, indicium such as barcodes recorded on a replenishing container and the medicine cassette are read by a barcode reader or the like. From comparison between both the indicium, it is determined whether or not the medicine in the replenishing container and the medicine in the medicine cassette coincide with each other. When the replenishing container in this technology is replaced with the vial bottle for application, this may contribute to prevention of errors in the medicine recovery operation.

Patent Document 1: JP 11-513954 A

DISCLOSURE OF THE INVENTION

Problems to be Solved by the Invention

However, the technology disclosed in Patent Document 1 described above is applied after the medicine cassette to which the medicine is recovered is specified, and has such a problem that it cannot contribute to enhance accuracy and efficiency of an operation of specifying, from several tens or more of the multiple medicine cassettes, the medicine cassette to which the medicine is to be recovered. In particular, in the medicine dispensing device, the medicine cassettes are attachable to/detachable from cassette mounting portions arranged in a plurality of rows, and mounting positions of the medicine cassettes receiving the specific medicines, respectively, may change. Accordingly, there is such a problem that it is difficult to rapidly and accurately specify the cassette mounting portion to which the medicine cassette which is subjected to the medicine recovery is mounted. This can apply not only to the medicine recovery operation, but also to a general operation of putting (hereinafter, referred to as supplying) the medicine into the medicine cassette.

Therefore, the present invention has been made in view of the above-mentioned circumstances, and it is an object of the present invention to provide the medicine dispensing device in which, in the operation of supplying the medicine to the medicine cassette, whose typical example is a case where the medicine once filled into the vial bottle is recovered to the medicine cassette (medicine receiving container), the operation of specifying the medicine cassette to which the medicine is to be supplied can be made more accurate and efficient, and an expiration date management of the medicine and a remaining amount management in the medicine cassette can be appropriately supported.

Means for Solving the Problems

In order to achieve the above-mentioned object, the present invention is applied to a medicine dispensing device including: a plurality of medicine receiving containers (the above-mentioned medicine cassette is a typical example thereof); a plurality of container mounting portions (the above-mentioned cassette mounting portion is a typical example thereof) each of which is provided with a predetermined display portion (such as an LED lamp) and to each of which each of the medicine receiving containers is mounted; and medicine dispensing means for dispensing a medicine of a kind and in an amount corresponding to contents of a prescription (that is, prescription) from the medicine receiving containers, and provided with: medicine specifying information input means for inputting medicine specifying information used for specifying the medicine; container mounting portion specification means for specifying the container mounting portion to which the medicine receiving container, for receiving the medicine corresponding to the medicine specifying information inputted through the medicine specifying information input means, is mounted; and notification display control means for setting the display portion provided to the specified container mounting portion to a notification display state. There may be conceived, as the medicine dispensing means, medicine filling means for filling a medicine of a kind and in an amount corresponding to contents of a prescription from the medicine receiving containers into a dispensing container (the above-mentioned vial bottle is a typical example thereof).

As a result, when an operator inputs information for specifying the medicine to be supplied to the medicine receiving container through the medicine specifying information input means, the container mounting portion to which the medicine receiving container for receiving the medicine is reported by the display portion thereof. Accordingly, it is possible to more accurately and more efficiently specify, from the multiple medicine containers, (the container mounting portion of) the medicine receiving container to which the medicine is to be supplied.

As a more specific first structure, there may be conceived one adopting, as the medicine specifying information input means, medicine specifying information reading means for reading from the dispensing container the medicine specifying information recorded thereon. In this case, there may be provided means for recording the medicine specifying information on each of the dispensing containers filled with the medicines by the medicine filling means.

Here, when adopting, as the medicine specifying information recording means and the medicine specifying information reading means, for example, means for affixing a label on which a barcode is recorded and means for optically reading the barcode (so-called barcode reader), since those are ones provided to a general medicine dispensing device, the ones can double as those means, thereby being preferable.

As a result, it is possible to avoid complication of operating input means such as a keyboard or a mouse, thereby achieving enhancing efficiency of an information inputting operation.

Further, it is preferable that the first structure be realized by utilizing means provided to the general medicine dispensing device.

That is, the general medicine dispensing device includes storage means for storing information (hereinafter, referred to as prescription and medicine reception correspondence information) in which prescription identification information for identifying the prescription and container mounting portion identification information for identifying the container mounting portion are brought into correspondence with each other.

More specifically, in general, there is provided means (dispensing history accumulation means) for allowing, when a predetermined dispensing process (process of delivering to predetermined medicine dispensing port) is performed for the medicine receiving container which is filled with the medicine by the medicine filling means, the storage means to store dispensing history information including at least prescription identification information corresponding to the medicine filling, and the prescription and medicine reception correspondence information is constituted by including the dispensing history information as a part or an entirety of its components.

Further, each of the dispensing containers filled with the medicine by the medicine filling means is provided with means for recording the prescription identification information (in general, means for recording barcode indicating prescription identification information on label and affixing it). Accordingly, this can be used as recording means for the medicine specifying information, and the recorded prescription identification information (such as barcode) can be used as the medicine specifying information. That is, the container mounting portion specification means may be one specifying, based on the prescription identification information and the prescription and medicine reception correspondence information which are read as the medicine specifying information by the medicine specifying information reading means, the container mounting portion to which the medicine receiving container for receiving the medicine is mounted, the medicine being the same as the medicine filled into the dispensing container from which the prescription identification information is read.

As a result, the first structure can be realized by utilizing the means provided to the general medicine dispensing device.

Meanwhile, in general, the medicine has an expiration date, so when the medicine whose expiration date is exceeded is supplied to the medicine receiving container (medicine cassette), a medical accident may occur. Accordingly, the expiration date management of the medicine supplied to the medicine receiving container is important. However, the related-art medicine dispensing device does not have a function of appropriately supporting the medicine expiration date management when the medicine recovery is performed.

Here, it is preferable that the first structure include: expiration date storage means for storing an expiration date of the medicine accommodated in each of the dispensing containers; expiration date reading means for reading (reading out), from the expiration date storage means, the expiration date of the medicine accommodated in the medicine receiving container mounted to the container mounting portion specified by the container mounting portion specification means; and expiration date warning notification means for notifying a predetermined warning (for example, warning indicating that recovery of the medicine from the above-mentioned dispensing container to the above-mentioned medicine reception container is prohibited) in a case where a result of a comparison between the expiration date read by the expiration date reading means and a current date and time does not match predetermined allowable conditions.

As a result, it is possible to prevent such a problem that a medicine whose expiration date is already exceeded or an old medicine whose expiration date is close is supplied.

Other than that, there can also be conceived one including: means for recording expiration date specifying information used for specifying the expiration date of the medicine on each of the dispensing containers for the patients, filled with the medicine by the medicine filling means; means for reading the expiration date specifying information recorded on the dispensing container for the patient; and means for notifying a predetermined warning in a case where the expiration date specifying information read thereby does not match allowable conditions.

In this case, in a case where there is provided means for recording the expiration date information of the medicine received in each of the medicine receiving containers, there is conceived one having, as the allowable conditions, conditions under which determination is made based on comparison between the expiration date based on the expiration date specifying information read by the specifying information reading means and the expiration date information stored in the medicine expiration date information storage means.

As a result, it is possible to prevent such a problem that the medicine (old medicine) whose expiration date is earlier or earlier for a predetermined period or more than that of the medicine which is already received.

On the other hand, it is conceivable that a second structure includes storage means for storing in advance medicine and reception correspondence information in which medicine information relevant to each of the medicines and container mounting portion identification information for identifying the container mounting portion are brought into correspondence with each other, and applied with, as the container mounting portion specification means, one including: medicine information search means for searching by keyword search or the like, the medicine and reception correspondence information, for candidates for medicine information relevant to medicine specifying information input by the medicine specifying information input means including operation input means such as a keyboard or a mouse and for presenting the candidate through predetermined information display means or the like; and medicine information selection means for selecting one piece of the medicine information from the candidates for the medicine information presented by the medicine information search means, the one specifying the container mounting portion corresponding to the medicine information selected by the medicine information selection means from the medicine and reception correspondence information.

In this case, as the medicine specifying information and the medicine information, there is conceived, for example, one including one or a plurality of name information, color information, shape information, size information, of the medicine, medicine identification information for identifying each of the medicines, and appearance photograph information of the medicine.

As a result, in a case where the medicine to be supplied to the medicine receiving container is not put in the container on which the medicine specifying information which can be read by the image reading means such as the barcode reader is recorded (for example, bare tablet as it is), (the medicine receiving container of) the container mounting portion to which the medicine is to be supplied can be specified easily and accurately. Specifically, when the search can be performed based on the color information, the shape information, and the size information of the medicine, it is also possible to deal with a case where the name and the identification information of the medicine is unknown.

Further, when the medicine information includes the appearance photograph information of the medicine, the provided appearance photograph information and actual appearance of the medicine can be checked through comparison therebetween, so it is possible to more reliably prevent an erroneous operation in which the medicine is supplied to the wrong medicine receiving container.

Further, the following are conceivable items common between the first structure and the second structure.

For example, for maintenance or the like of a medicine supply time with respect to the medicine receiving container (medicine cassette), it is important to understand a remaining amount of the medicine in the medicine receiving container. However, the related-art medicine dispensing device does not have a function by which the remaining amount management of the medicine in the medicine receiving container can be appropriately performed.

In general, the medicine dispensing device includes means (first medicine remaining amount update means) for updating, by subtraction, the remaining amount information of the medicine in each of the medicine receiving containers stored in a predetermined storage means according to a dispensing amount of the medicine dispensed by the medicine dispensing means (corresponding to a filling amount of the medicine filled by the medicine filling means).

In the case where there is provided the above-mentioned means, it is preferable that there be further provided medicine supply amount obtaining means for obtaining a medicine supply amount to the medicine receiving container (hereinafter, referred to as object medicine receiving container) for receiving the medicine corresponding to information input through the medicine specifying information input means, and means (second medicine remaining amount update means) for updating the remaining amount information of the medicine in the object medicine receiving container, by addition of the medicine supply amount obtained by the medicine supply amount obtaining means, when the medicine is supplied to the object medicine receiving container.

As a result, it is possible to prevent such a problem that, when the medicine recovery is performed, in each of the medicine receiving containers, the remaining amount information of the medicine stored in the storage means does not match the actual medicine remaining amount.

Here, as the medicine supply amount obtaining means, there is conceived predetermined operation input means for manually inputting the medicine supply amount. However, other than that, there is also conceived one including means for reading information (predetermined information used for specifying medicine supply amount) such as a barcode recorded on the medicine receiving container or stored data of an IC tag, and means for specifying the medicine supply amount based on the read information.

Further, in the general medicine dispensing device, the remaining amount information of the medicine is stored in the storage means by being brought into correspondence with receiving container identification information for identifying each of the medicine receiving containers. (This recorded information is referred to as receiving container remaining amount information). Further, the receiving container identification information is normally stored in the storage means by being brought into correspondence with the prescription identification information by, for example, the prescription and medicine reception correspondence information or filling history information of the medicine, which is stored in the predetermined storage means each time the medicine is filled into the dispensing container by the medicine filling means. That is, the prescription and medicine reception correspondence information is information in which the prescription identification information for identifying each of the prescriptions of the medicines for the patient, information of contents of the prescription, the medicine receiving container identification information for identifying the medicine receiving container receiving the prescribed medicine, and container mounting portion identification information for identifying the container mounting portion to which the medicine receiving container is mounted are brought into correspondence with each other. Alternatively, the filling history information is information in which the prescription identification information corresponding to the executed medicine filling and the medicine receiving container identification information are brought into correspondence with each other.

Therefore, as the second medicine remaining amount update means, there is conceived one that, in a case where the prescription identification information is recorded on the dispensing container in the first structure, specifies remaining amount information of the medicine, updated by addition based on the prescription identification information, the prescription and medicine reception correspondence information or the filling history information, and the receiving container remaining amount information which are read by the medicine specifying information reading means.

Further, the general medicine dispensing device includes container attachment/detachment detecting means for detecting an attachment/detachment state of the medicine receiving container for each of the container mounting portions. In this context, it is more preferable that there be provided container erroneous-removal warning means for performing, for the container mounting portion other than the container mounting portion whose display portion is brought into the notification display state by the notification display means, a predetermined warning notification when removal of the medicine receiving container is detected by the container attachment/detachment detecting means.

As a result, in a state where the multiple container mounting portions are closely arranged, when the medicine receiving container is erroneously removed from the container mounting portion other than the container mounting portion whose display portion is in the notification display state (for example, adjacent container mounting portion), the error can be notified by the warning notification.

Other than that, there is also conceived, for example, one having locking means for performing locking and unlocking of each of the container mounting portions in a state where the medicine receiving container is mounted, and lock control means for controlling the locking means such that, in a case where the display portion is brought into the notification display state by the notification display means, the unlocking is performed only for the container mounting portion whose display portion is in the notification display state.

EFFECTS OF THE INVENTION

According to the present invention, by inputting the predetermined medicine specifying information used for specifying the medicine, the container mounting portion to which the medicine receiving container for receiving the medicine corresponding to the input information is mounted is specified. The display portion provided to the specified container mounting portion is controlled to be brought into the predetermined notification display state, thereby making it possible to perform the operation of specifying, from the multiple medicine containers, (the container mounting portion of) the medicine receiving container to which the medicine is to be supplied can be made more accurate and efficient.

Specifically, with a structure provided with means for recording the medicine specifying information on each of the dispensing containers filled with the medicine, and means for reading the recorded information as the medicine specifying information, complication of operating input means such as a keyboard or a mouse is avoided, thereby achieving enhancing efficiency of an information inputting operation. Further, the recording means and the reading means are preferable in that barcode recording means, barcode reading means, and the like provided to the general medicine dispensing device can be effectively utilized.

Further, in a case where there is provided expiration date storage means for storing the expiration date of the medicine accommodated in each of the dispensing containers, there is provided means for reporting a predetermined warning when the expiration date of the medicine accommodated in the medicine receiving container mounted to the container mounting portion specified by the container mounting portion specification means is read (read out) from the expiration date storage means and a result of a comparison between the read expiration date and a current date and time does not match the predetermined allowable conditions, thereby making it possible to prevent such a problem that a medicine whose expiration date has passed, an old medicine whose expiration date is close, or the like is supplied. This enables appropriate expiration date management, thereby leading to prevention of medical accidents.

Further, by inputting, for example, the name information, the color information, the shape information, or the size information of the medicine, the medicine identification information for identifying each of the medicines, the appearance photograph information of the medicine, or the like, based on the input information, candidates for the relevant medicine are searched from the medicine information stored in advance to be presented. Accordingly, one piece of the medicine information can be selected from the candidates, thereby making it possible to easily and accurately specify (the medicine receiving container of) the container mounting portion to which the medicine is to be supplied, even in a case where the medicine to be supplied to the medicine receiving container is not put in the container from which the medicine specifying information which can be read by the information reading means such as a barcode reader is recorded (for example, bare tablet as it is). Specifically, when the medicine information includes the appearance photograph information of the medicine, the provided appearance photograph information and actual appearance of the medicine can be checked through comparison therebetween, so it is possible to more reliably prevent an erroneous operation in which the medicine is supplied to the wrong medicine receiving container.

Further, in a case where the medicine supply amount to the medicine receiving container (object medicine receiving container) for receiving the medicine corresponding to the input medicine specifying information is obtained and the medicine is supplied to the object medicine receiving container, when the remaining amount information of the medicine in the object medicine receiving container is updated by adding the obtained medicine supply amount thereto, in each of the medicine receiving containers, it is possible to prevent such a problem that the remaining amount information of the medicine stored in the storage means does not match the actual medicine remaining amount. As a result, accurate medicine remaining amount management can be performed.

BEST MODE FOR CARRYING OUT THE INVENTION

Hereinafter, with reference to the attached drawings, an embodiment of the present invention will be described for understanding of the present invention. Note that the embodiment described below is an example in which the present invention is embodied, and does not have characteristics of limiting a technical scope of the present invention.

Here, FIG. 1 is a perspective view and a partial enlarged view of a main body of a medicine dispensing device X according to the embodiment of the present invention. FIG. 2 is a block diagram showing a structure of a main portion of the medicine dispensing device X. FIG. 3 is a flow chart showing a procedure of a medicine dispensing process in the medicine dispensing device X. FIG. 4 is a flow chart showing a procedure of processes such as medicine handover in the medicine dispensing device X. FIG. 5 is a flow chart showing a procedure of a medicine supply-time process in the medicine dispensing device X. FIG. 6 are diagrams each showing structures of various kinds of databases and data related to the medicine dispensing device X. FIG. 7 is a view showing a display example at the time of medicine supply-time process in the medicine dispensing device X. FIG. 8 is a view showing an example of a label affixed to a vial bottle by the medicine dispensing device X.

The medicine dispensing device X according to the embodiment of the present invention is installed in a pharmacy or the like and dispenses medicines separately for each prescription by filling, into each of predetermined containers called vial bottles (an example of the dispensing container), a medicine of a kind and in an amount corresponding to contents of the medicine prescription for each of the patients, from a plurality of medicine cassettes which are containers each receiving a specific medicine (tablet in this embodiment). The vial bottle filled with the medicine is provided to the patient as described above.

Here, the medicine dispensing device X is characterized in that, by inputting predetermined information (medicine specifying information) used for specifying a medicine, a cassette shelf to which the medicine cassette receiving the medicine corresponding to the input information is mounted is specified, and control is performed such that a shelf lamp (an example of the display portion) provided to the specified cassette shelf is in a predetermined notification display state. As a result, it is possible to improve accuracy and efficiency of an operation of specifying the medicine cassette to be supplied with the medicine from multiple medicine cassettes, and the cassette shelf to which the medicine cassette is mounted.

First, with reference to the perspective view of FIG. 1 and the block diagram of FIG. 2, a description will be made of a structure of the medicine dispensing device X.

The medicine dispensing device X mainly includes, as shown in FIG. 2, a main body device 100 and a management computer 200.

The main body device 100 includes, as shown in FIG. 2, a plurality of medicine cassettes 1 (an example of the medicine receiving container) each receiving a specific medicine, cassette shelves 2 (an example of the container mounting portion) which are arranged in a plurality of rows in a surface of the main body device 100, which serve as portions to which the medicine cassettes 1 are mounted, respectively, and to which shelf lamps 3 serving as predetermined display portions are provided, respectively, and a vial bottle accommodating portion 5 in which the vial bottles which are medicine dispensing containers for the patients are accommodated in an empty state.

Further, the main body device 100 includes, as shown in FIG. 2, a cassette sensor 101, a bottle taking-out/conveying machine 102, a medicine filling machine 103, a medicine counter 104, a communication interface 105, a label output machine 106, a barcode reader 107, a display/operation portion 108, and a control portion 109. In the following, each of the components will be described.

A cassette sensor 101 is a sensor (an example of the container attachment/detachment detecting means) for detecting an attachment/detachment state of the medicine cassette 1 with respect to each of the cassette shelves 2, and includes a contact switch for detecting a displacement state of a predetermined displacement portion displaced by being brought into contact with the mounted medicine cassette 1, a non-contact switch such as a photosensor (photocoupler) of a transmission type or a reflection type.

The bottle taking-out/conveying machine 102 is an actuator which takes out the empty vial bottle accommodated in the vial bottle accommodating portion 5, conveys the vial bottle to the cassette shelf 2 which is a mounting portion for the medicine cassette 1 receiving a medicine of a kind corresponding to contents of medicine prescription for each patient, and further conveys the vial bottle filled with the medicine from the medicine cassette 1 in the cassette shelf 2 to a medicine dispensing port 4 (see FIG. 1) on a front surface of the main body device 100.

The medicine filling machine 103 is an actuator for filling, into the vial bottle conveyed by the bottle taking-out/conveying machine 102 to the predetermined cassette shelf 2, the medicine in an amount (number) corresponding to the contents of the medicine prescription for each of the patients, from the medicine cassette 1 mounted in the cassette shelf 2. In general, there are provided a rotation driving portion moved by the bottle taking-out/conveying machine 102 together with the vial bottle to each of the cassette shelves 2, and a medicine sending-out mechanism, provided to each of the medicine cassettes 1, for sending out (dropping) the medicine (tablet) in the medicine cassette 1 one by one to the vial bottle side by being rotated by the rotation driving portion. An rpm of the rotation driving portion is controlled, thereby controlling a filling amount (filling number) of the medicine.

Further, the medicine counter 104 is a sensor for detecting the number of the medicine which are filled when the medicine are filled one by one by the medicine filling machine 103. For example, based on the number of times of ON/OFF change of, for example, a contact switch which detects a displacement state of a displacement portion which is displaced by being brought into contact with the dropping medicine or the non-contact switch such as the photosensor (photo coupler) of the transmission type or the reflection type, the number (filling amount) of the medicine which are filled is detected.

Here, the bottle taking-out/conveying machine 102, the medicine filling machine 103, and the medicine counter 104 constitute an exemplary medicine filling means for filling, into each of the vial bottles (dispensing container), the medicine of the kind and in the amount (number) corresponding to the contents of the medicine prescription for each patient, from the medicine cassettes 1.

The communication interface 105 is used for performing communication with the management computer 200 connected through a predetermined communication line 11. Here, the management computer 200 can communicate with a host computer Y which is an external device connected through a predetermined network 10. Through the management computer 200, information sent from the host computer Y is transmitted to the main body device 100.

The label output machine 106 prints (records) information related to the medicine prescription on a label s, and affixes the label to the vial bottle.

FIG. 8 shows an example of a label s which is affixed to the vial bottle by the label output machine 106. As shown in FIG. 8, on the label s, a prescription code (an example of the prescription identification information) for identifying each of the medicine prescriptions (prescriptions) for the patients is recorded as a barcode p1 and a character string information p2, and there are also recorded a medicine information p3 such as a name or usage of the prescribed medicine (that is, medicine filled into vial bottle) quantity (number of tablets), use-by date, a name of a manufacturer, an expiration date p4 of the medicine, a doctor information p5 such as a name of the doctor who has prescribed, a patient information p6 such as a name and an address of the patient, various kinds of comment information p7 (such as caution), and a shop information p8 such as a name and an address of a pharmacy providing the medicine.

The label output machine 106 affixes a label on which various kinds of information as shown in FIG. 8 including the prescription code (barcode p1 and character string information p2 thereof) are printed to each of the vial bottles filled with the medicines by the medicine filling machine 103, thereby recording the printed information on the vial bottle (an example of medicine specifying information recording means and means for recording expiration date specifying information). Note that, as described later, the prescription code is information used for specifying the medicine filled into the vial bottle by being compared with a dispensing history DB d4 (an example of the medicine specifying information) and is also information used for specifying the expiration date of the medicine (expiration date specifying information).

The barcode reader 107 optically reads the barcode indicating the prescription code (information for identifying the medicine prescription for each of the patients) recorded on the vial bottle (an example of the medicine specifying information input means, the medicine specifying information reading means, and the means for reading expiration date specifying information). Here, the prescription code is information used for specifying the medicine, the medicine cassette 1, and the cassette shelf 2 as described later and is also information used for specifying the expiration date of the medicine.

The display/operation portion 108 is a liquid crystal touch panel, an EL touch panel, or the like provided to a part of the main body device 100 (see FIG. 1), is displaying means for displaying various kinds of information, and is also operation input means receiving an operation input by a user.

The control portion 109 includes a CPU and peripheral devices thereof (such as RAM or ROM), and controls components provided to the main body device 100 by inputting detection results of various sensors such as the cassette sensor 101 and the medicine counter 104 and by allowing the CPU to execute a control program recorded in the ROM in advance.

Further, the management computer 200 is a computer such as a personal computer connected to the main body device 100 through the predetermined communication line 11 and also connected to the external host computer Y through the predetermined network 10, and includes in addition to a calculation portion including a CPU and peripheral devices thereof (such as RAM or ROM), various components provided to a general computer, including storage means such as a hard disk on which various kinds of data or programs are stored, operation input means such as a key board and a mouse, and display means such as a liquid crystal display.

FIG. 6 are diagrams each showing data structures of various kinds of databases (DB) stored on the storage means (such as hard disk) provided to the management computer 200 and data structures of prescription data received by the medicine dispensing device X from the external host computer Y.

As shown in FIG. 6, the management computer 200 stores the databases such as (a) a medicine master DB (d1), (b): a cassette DB (d2), (d): the dispensing history DB (d4), and (e): medicine supplying history DB (d5). Further, the medicine dispensing device X receives (c) prescription data d3 for each of the patients from the host computer Y.

The medicine master DB (d1) includes information in which, for each kind of the medicines, pieces of information related to the medicine (medicine information) are brought into correspondence with one another, and is, as shown in FIG. 6(*a*), a data group in which a medicine code d11 (NDC: National Drug Code) for identifying the medicine, a medicine name d12, and a unit d13 (such as sheet, CAP, or tablet) at a time of managing the quantity, mode information d14 of the medicine (such as tablet, capsule, or external use/patch), usage information d15 (such as intake period or timing), appearance photograph data d16, shape information d17 (such as disk shape or spherical shape), dimension information d18, and color information d19 are stored while being brought into correspondence with one another.

Further, the cassette DB (d2) is information in which the kind of the medicine and the cassette shelf 2 to which the medicine cassette 1 receiving the medicine is currently mounted are brought into correspondence with each other, and is, as shown in FIG. 6(*b*), a data group in which a cassette code d21 which is information for identifying each of the cassette shelves 2 to which the medicine cassettes 1 are mounted (in a case where mounting position of medicine cassette 1 is not changed, also referred to as identification information for medicine cassette 1), the medicine code d11 (NDC) for identifying the medicine received in the medicine cassette 1 in that cassette shelf 2, and a remaining amount (remaining number) information d22 of the medicine currently received by the medicine cassette 1 in that cassette shelf 2 are stored while being brought into correspondence with one another. The cassette DB (d2) is a database which is continuously updated to a latest state by, for example, the operation input through the display/operation portion 108 every time the cassette shelf 2 to which the medicine cassette 1 is mounted is changed.

Further, the prescription data d3 is information indicating the contents of the prescription for each patient, and is a data group including as a single group a prescription code d31 which is information for identifying each of the contents of the prescriptions for the patient, the NDC (d11) indicating the prescribed medicine, the medicine name d12, a prescribed quantity d32 of the medicine, a container size d33 indicating a size (kind) of the vial bottle filled with the medicine, and a label printing information d34 including various kinds of information to be recorded (printed) on the label s (see FIG. 8).

Further, the dispensing history DB (d4) is information in which history information (hereinafter, referred to as dispensing history information) is additionally recorded (stored) on the storage means of the management computer 200 every time the filling of the medicine into the vial bottle and the dispensing (conveying of vial bottle to dispensing port 4) are completed, and is, as shown in FIG. 6(*d*), a data group in which the dispensing history information including a dispensing date and time d41 indicating a date on which the dispensing (filling of medicine into vial bottle) is performed, the prescription code d31 for identifying the medicine prescription corresponding to the dispensing, the medicine code d11 (NDC) indicating the prescribed medicine, the cassette code d21 indicating the cassette shelf 2 corresponding to the medicine cassette 1 from which the dispensing is performed, a quantity of the dispensing (dispensed quantity d42), and an expiration date d43 of the dispensed medicine are accumulated and stored while being brought into correspondence with one another.

Here, the dispensing history DB (d4) and the cassette DB (d2) have the NDC (dll) in common. Accordingly, the prescription code d31 (an example of the prescription identification information for identifying each of the medicine prescriptions for the patient) of the dispensing history DB (d4) is brought into correspondence with the cassette code d21 in the cassette DB (d2) for identifying the cassette shelf 2 to which the medicine cassette 1 receiving the prescribed medicine is mounted, and those are examples of prescription and medicine reception correspondence information. In this case, every time the medicine dispensing process (process in which vial bottle is conveyed to medicine dispensing port 4) is performed, the dispensing history information including the prescription code d3l corresponding to the medicine filling constitutes a part of the prescription and medicine reception correspondence information.

Note that the dispensing history DB (d4) stored in the storage means of the management computer 200 includes the processing code d31 (an example of the processing identification information for identifying each of the medicine prescriptions of for the patient) and the cassette code d21 which are brought into correspondence with each other. In a case where the mounting position of the medicine cassette 1 is not changed, the dispensing history DB (d4) can also be perceived as an example of the prescription and medicine reception correspondence information. In this case, the dispensing history DB (d4) which is a collection of pieces of dispensing history information constitute an entirety of the prescription and medicine reception correspondence information.

Further, in the dispensing history DB (d4), the medicine code d11 and the expiration date information d43 of the medicine are brought into correspondence with the processing code d31. Accordingly, the prescription code d31 is an example of the medicine specifying information which can be used for specifying the medicine which is prescribed for the patient, and is an example of the expiration date specifying information which can be used for specifying the expiration date of the medicine.

Further, the cassette DB (d2) and the medicine master DB (dl) which are stored in the storage means of the management computer 200 have the NDC (d11) in common. Accordingly, pieces of the medicine information d12 to d19 related to each of the medicines and the cassette code d21 (an example of the container mounting portion identification information) for identifying the cassette shelf 2 to which the medicine cassette 1 receiving each of the medicines is mounted, thereby being an example of medicine and reception correspondence information.

Note that, when the dispensing history DB (d4) includes information indicating a current processing state of the prescribed medicine (one of states when the medicine "has not been handed over" to patient, where the medicine "has been handed over" to patient, and where the medicine "has been recovered" to original medicine cassette 1, or the like), it is possible to understand, of the already dispensed medicines (vial bottles), how many medicines remain, which have not been handed over to the patients, thereby being preferable.

Further, the medicine supplying history DB (d5) is information in which, every time the medicine is supplied to the medicine cassette 1 of each of the cassette shelves 2, the history thereof (hereinafter, referred to as supplying history data) is additionally recorded, and is, as shown in FIG. 6(*e*), a data group in which supply date information d51 indicating date on which the medicine supply is performed, the cassette code d21 for identifying each of the cassette shelves 2 to which the medicine cassettes 1 are mounted, the NDC (d11) indicating the kind of the supplied medicine, a supplied quantity d52 indicating a quantity of the supplied medicine, an expiration date d53 of the supplied medicine, and a supplier information d54 indicating a representative who has performed the medicine supply are brought into correspondence with each other to be stored. Storage means for the medicine supply history DB (d5) is an example of expiration date storage means.

Here, when a combination of the cassette code d21 and the NDC (d11) is specified, with reference to (by searching) the medicine supplying history DB (d5), one or a plurality of pieces of supplying history data corresponding to the combination are specified. Of those pieces of the supplying history data, the expiration date d53 provided to the one whose supply date d51 is the latest shows the expiration date of the medicine which is currently received by the medicine cassette 1.

Next, with reference to the flow chart of FIG. 3, a description will be made of the procedure of the medicine dispensing process in the medicine dispensing device X. The dispensing process of the medicine is a process performed by executing a predetermined control program by each of the CPUs of the control portion 109 and the management computer 200. Hereinafter, Steps S101, S102, . . . are identification symbols of the process procedure (steps). Note that the dispensing process of the medicine described below is the same as a process executed by a related-art medicine dispensing device.

First, when, by the management computer 200, from the host computer Y which is an external device connected thereto through the network 10, the prescription data d3 for each patient is received (S101), searching the database stored in the storage means is performed by the management computer 200, and there is performed a process of specifying the medicine cassette 1 receiving the medicine corresponding to the received prescription data d3 and the cassette shelf 2 to which the medicine cassette 1 is mounted (S102).

Specifically, as shown in FIG. 6(*c*), the prescription data d3 includes the medicine code d11 (NDC), so search is performed in the cassette DB (d2) (see FIG. 6(*a*)) with the NDC (d11) serving as a search key to specify (obtain) the corresponding cassette code d21. At the same time, there is also obtained the expiration data d53 specified by searching the medicine supplying history DB (d5) based on the NDC (d11) of the medicine and the cassette code d21 thereof.

Next (or simultaneously with the processes in the above-mentioned Steps S101 and S102), the control portion 109 controls the bottle taking out/conveying machine 102, thereby allowing the empty vial bottle to be moved to the specified cassette shelf 2 from the vial bottle accommodating portion 5, and at the same time, in midway through the movement, by the label output machine 106, printing of the label s as shown in FIG. 8 or affixation thereof to the vial bottle is performed. (S103).

Specifically, a predetermined medicine dispensing instruction including the cassette code d21 (identification information of cassette shelf 2) specified in Step S102, the prescribed quantity information d32, the container size d33, and the label printing information d34, which are included in the prescription data d3, is transmitted from the management computer 200 to the control portion 109 through the communication line 11 and the communication interface 105, and the control portion 109 controls the bottle taking-out/conveying machine 102, thereby allowing the empty vial bottle to move from the vial bottle accommodating portion 5 to the cassette shelf 2 which is specified based on the cassette coded 21 by the medicine dispensing instruction.

Here, the vial bottle accommodating portion 5 is provided by being divided based on a size (kind) of the vial bottle. The bottle taking-out/conveying machine 102 takes out the empty vial bottle from the vial bottle accommodating portion 5 corresponding to the container size d33 included in the medicine dispensing instruction to convey the empty vial bottle to the specified cassette shelf 2. Further, the printing information p1 to p8 for the label s shown in FIG. 8 are included in the label printing information d35 of the prescription data d3 (see FIG. 6(*c*)) received from the host computer Y.

Further, from the medicine cassette 1 in the cassette shelf 2 set to be a destination of the vial bottle in the process of Step S103, a medicine filling process to the vial bottle is performed (S104).

Specifically, the control portion 109 controls the medicine filling machine 103, thereby performing a medicine filling operation from the medicine cassette 1 to the vial bottle by a quantity according to the prescribed quantity information d32 specified by the medicine dispensing instruction. At that time, by the medicine counter 104, counting of the medicine filling amount is performed until the quantity according to the prescribed quantity information d32 is reached, the quantity obtained by the counting is transmitted from the control portion 109 to the management computer 200, and the quantity obtained by the counting is subtracted from the remaining amount information d22 in the cassette DB (d2), thereby achieving data update. That is, by the management computer 200, the remaining amount information d22 of the medicine in each of the medicine cassettes 1, which is stored as the cassette DB (d2) in the storage means thereof, is updated by subtraction according to the filling amount of the medicine by the medicine filling machine 103 (an example of a first medicine remaining amount update means).

Further, during filling of the medicine, by the control portion 109, whether or not running out of the medicine in the medicine cassette 1 occurs is monitored (S105), and based on determination on whether or not a count number obtained by the medicine counter 104 reaches the quantity of the prescribed quantity information d32, whether or not the filling of the medicine is completed is determined (S106).

Here, in a case where, although the medicine filling operation by the medicine filling machine 103 is performed for at least a certain period of time, a state where the medicine filling amount obtained by the medicine counter 104 is not counted up is detected by the control portion 109, it is determined that the running out of the medicine in the medicine cassette 1 occurs (Y side of S105). In this case, the control portion 109 allows the shelf lamp 3 provided to the cassette shelf 2 to blink and allows a predetermined buzzer to output a warning sound (S109). As a result, the user is notified of the occurrence of the running out of the medicine, and the medicine supply to the medicine cassette 1 is urged.

When completion of the medicine supply to the medicine cassette 1 in which the running out of the medicine occurs is detected by the control portion 109 (S110), this is notified from the control portion 109 to the management computer 200, and in the management computer 200, the remaining amount information d22 in the cassette DB (d2) and the expiration date information d53 corresponding to the cassette code d21 of the medicine cassette 1 are initialized (S111) and the shelf lamp 3 is turned of f by the control portion 9 (S112), and the process returns to Step S104. Accordingly, the medicine filling process is continued.

Here, examples of the detection (determination) of the medicine supply completion include, for example, the determination of the medicine supply completion based on detection of a predetermined medicine supply completion operation through the display/operation portion 108, and the determination of the medicine supply completion based on detection by the cassette sensor 101 of dismounting and mounting of the medicine cassette 1 with respect to the cassette shelf 2 whose shelf lamp 3 is allowed to blink in Step S109.

Further, it is also conceivable that, at the time of medicine supply, as disclosed in Patent Document 1, on each of a medicine container from which the medicine is supplied and the medicine cassette 1, the medicine code d11 for identifying the medicine to be received is recorded as the barcode in advance, both the barcodes (medicine codes d11) are read by the barcode reader 107, and depending on the determination result that the medicine codes d11 which have been read coincide or do not coincide with each other, the determination is made whether or not the correct medicine supply has been performed. In this case, it is conceivable that, when both the medicine codes d11 are determined that they do not coincide with each other, a warning sound is output or the like.

Further, it is conceivable that, in a case where an initial value of the remaining amount information d22 is determined in advance (case where a capacity of the medicine container from which the medicine is supplied is determined in advance), the initial value thereof is recorded in the management computer 200 or the like in advance and the value thereof is automatically set. Further, it is conceivable that, in a case where a plurality of candidates of the initial value are determined in advance, the candidates are displayed on the display/operation portion 108, and the user is allowed to perform selection from those candidates. Other than that it is also conceivable that, through the display/operation portion 108, the user is allowed to input the initial value as a numerical value.

Further, it is conceivable that the initial value of the expiration date information d53 is input by allowing the user to perform the numerical value input through the display/operation portion 108, by allowing the expiration date information to be recorded as the barcode on the container in advance, from which the medicine is supplied, and reading the barcode by using the barcode reader 107, or the like.

On the other hand, when, in Step S106, it is determined that the medicine filling is completed, by the bottle taking-out/conveying machine 102, the vial bottle with respect to which the medicine filling is completed is conveyed from the cassette shelf 2 to the medicine dispensing port 4 (medicine dispensing process, S107).

When the medicine dispensing process is normally performed as described above, a process of recording the dispensing history is performed by the management computer 200, that is, a process of additionally registering (accumulating and storing) the dispensing history information with the dispensing history DB (d4) (see FIG. 6(*d*)) is performed (S108), and the medicine dispensing r process ends. The dispensing history information includes the prescription code d31 as shown in FIG. 6(*d*), and the management computer 200 performing the process of Step S108 is an example of dispensing history information accumulation means. Note that, in a case where the medicine dispensing process is not normally ended in Step S107 due to failure in conveyance of the vial bottle or the like, the process of additionally registering data with the dispensing history DB (d4) is not performed.

Here, the data to be recorded (registered) as the dispensing history information is obtained from the following.

That is, as the dispensing date and time d41, there is used a current date and time timed by timing means (clock function) of the management computer 200 or the like. As the prescription code d31, the medicine code dill, and the dispensing quantity, there are used the prescription code d31, the medicine code d11, and the prescribed quantity information d32, which are included in the prescription data d3, received from the host computer Y, respectively.

Further, as the cassette code d21 and the expiration date d43, there are used the cassette code d21 searched (specified) from the cassette DB (d2) in Step S102, and the expiration date d53 (corresponding to latest supply date d51) specified with reference to (by searching) the medicine supply history DB d5 based on the cassette code d21 and the NDC (d11) corresponding thereto, respectively. Note that it is also conceivable that, for example, the expiration date d43 is set to a date expecting a predetermined safety factor of the expiration date d53 searched from the medicine supply history DB (d5).

Next, with reference to the flowchart of FIG. 4, a procedure of the processes such as the medicine handover will be explained. The processes such as the medicine handover are processes performed by allowing each of the CPUs of the control portion 109 and the management computer 200 to execute a predetermined control program, and are started when a predetermined operation is performed through the display/operation portion 108. Note that the processes such as the medicine handover as described below are the same as the processes performed by the related-art medicine dispensing device except contents of a medicine supply-time process (S132).

First, when the control portion 109 detects that the predetermined operation is performed through the display/operation portion 108, it is determined whether or not the operation is an operation of starting a medicine handover process (S121).

The medicine handover process is a process performed when the vial bottle filled with the medicine (dispensed medicine) is handed over to the patient.

Here, when the operation is determined to be the operation of starting the medicine handover process, there is performed a process in which the barcode of the prescription code d31 recorded on (label s of) the vial bottle which is a processing object is read by the barcode reader 107 (S122).

Further, after other processes (S123) such as a process of settling fees involved in the medicine handover to the patient are performed, the processes such as the medicine handover end.

In the process of Step S123, it is also conceivable that, by the management computer 200, a process of updating the dispensing history DB (d4) based on the prescription code d31 read by the barcode reader 107 is performed. That is, in the dispensing history DB (d4), information indicating the processing state of each of pieces of data are stored in correspondence with the prescription code d31 in advance, and the processing state of the piece of data in correspondence with the prescription code d31 read by the barcode reader 107 is updated from the initial value, that is, the state where it "has not been handed over" to the state where it "has been handed over". Alternatively, it is also conceivable that the subject piece of data is deleted.

In this manner, by updating the processing state in each of the pieces of data in the dispensing history DB (d4) in response to the medicine handover to the patient, each of the vial bottle bottles to which the medicine is dispensed (filled) (that is, each of the prescriptions for each of the patients) can be managed (referred to) by being distinguished between the one which has been handed over to the patient and the one which has not been handed over thereto.

On the other hand, in a case where, in Step S121, it is determined that the operation is not the operation of starting the medicine handover process, it is further determined by the control portion 109 whether or not the operation is an operation of starting the medicine supply-time process (S131). In a case where it is determined that the operation is the operation of starting the medicine supply-time process, the medicine supply-time process (S132) described later is executed, and the processes such as the medicine handover then ends.

Further, in a case where, in Step S131, it is determined that the operation is not the operation of starting the medicine supply-time process, other processes (S141) corresponding to the operation is executed, and the processes such as the medicine handover then ends.

Next, with reference to the flowchart of FIG. 5, a detailed description will be made of contents of the medicine supplying time operation (S132) which is the operation characterizing the medicine dispensing device X of the present invention. The medicine supply-time process is the process performed by executing the predetermined control process performed, by allowing each of the CPUs of the control portion 109 and the management computer 200 to execute a predetermined control program.

First, by the control portion 109, the operation detected through the display/operation portion 108 is determined which of an operation of starting a medicine recovery-time process at a time of and an operation of starting the medicine supply-time process (S201).

Here, the medicine recovery-time process is a process performed with respect to the medicine dispensed by being filled into the vial bottle through the process shown in FIG. 3, when the medicine is recovered from the vial bottle to the original medicine cassette 1 in order to prevent the medicine from being wasted because, for example, the patient does not appear to pick up within the predetermined period of time.

On the other hand, the medicine supply-time process other than that is a process performed when the medicine (for example, the bare tablet which is mistakingly dispensed) which is not received in the vial bottle on which the barcode (prescription code d31) is recorded is supplied to the medicine cassette 1 receiving the same medicine.

When, in Step S201, it is determined that the operation is the operation of starting the medicine recovery-time process, the label s of the vial bottle is brought close to a barcode reading window (reading light output window) of the barcode reader 107 by an operator, thereby allowing the barcode of the prescription code d31 recorded on (label s of) the vial bottle to which the medicine is recovered to be read by the barcode reader 107 (S202). The prescription code d31 which is read is transmitted to the management computer 200 from the barcode reader 107.

Next, by the management computer 200, searching the dispensing history DB (d4) and the cassette DB (d2) stored in the storage means of the management computer 200 is performed, and a process of specifying the dispensing history information of the medicine corresponding to the prescription code d31 (an example of the medicine specifying information) read by the barcode reader 107, and the cassette shelf 2 to which the medicine cassette 1 receiving the medicine is mounted is executed (S203, example of container mounting portion specification means).

Specifically, by searching the dispensing history DB (d4), the dispensing history information corresponding to the prescription code d31 read by the barcode reader 107 is specified, and by using the NDC (d1) included in the dispensing history information as the search key, the cassette code d21 (the identification information of cassette shelf 2) is specified by searching the cassette DB (d2), thereby specifying the cassette shelf 2.

Note that there may be adopted a structure in which, in a case where there is no change in mounting position of the medicine cassette 1, the cassette shelf 2 is specified by searching for the cassette code d21 corresponding to the prescription code d31 read by the barcode reader 107 from the dispensing history DB (d4).

Next, in a case where, by the management computer 200, it is determined whether or not the dispensing history information corresponding to the prescription code d31 read from the vial bottle exists in the dispensing history DB (d4) (S204), and it is determined that it does not exist (is not found), there is performed notification thereof from the management computer 200 to the control portion 109. By the control portion 109, predetermined warning display is performed through the display/operation portion 108 and a warning sound is output (S214) through the warning buzzer (not shown), and the medicine supply process then ends.

Further, even in a case where the dispensing history information corresponding to the prescription code d31 read from the vial bottle exists, by the management computer 200, with reference to the expiration date d43 included in the dispensing history information, it is determined whether or not this matches predetermined allowable conditions (S205). Here, in a case where the expiration date d43 does not match the allowable conditions, notification thereof from the management computer 200 to the control portion 109 is performed, and by the control portion 109, predetermined warning display is performed through the display/operation portion 108 and a warning sound is output (S215, example of expiration date warning notification means) by the warning buzzer (not shown), and the medicine supply process then ends.

On the other hand, in a case where, in Step S205, it is determined that the expiration date d43 matches the allowable conditions, the process is moved to Step S206 described later.

Hereinafter, a description will be made of an example of the allowable conditions for the expiration date d43.

For example, as an example of the allowable conditions, there is conceived a condition where determination is made based on a comparison between the expiration date d43 specified based on the prescription code d31 (an example of the expiration date specifying information) read by the barcode reader 107 (an example of the expiration date specifying information reading means) and a current date and time timed by the timing means (the clock function of timing the current date and time) provided to the management computer 200.

In this case, there is conceived a condition where, for example, when the expiration date d43 based on the dispensing history DB (d4) is past the current date and time, or when the expiration date d43 is in a predetermined period of time from the current date and time, the expiration date d43 is not allowable, and when the expiration date d43 is later than (in the future of) that, the expiration date d43 is allowed.

Further, as another example of the allowable conditions, there is also conceived a condition where the determination is made based on a comparison, by using the medicine supplying history DB (d5) storing the expiration date d53 of each of the medicines received by the medicine cassettes 1, between the expiration date d43 specified based on the prescription code d31 (an example of the expiration date specifying information) read by the barcode reader 107 (an example of the expiration date specifying information reading means) and the corresponding expiration date d53 stored in the medicine supplying history DB (d5). Note that the storage means of the management computer 200, storing the medicine supplying history DB (d5), is an example of medicine expiration date information storage means.

For example, there is conceived a condition where, in a case where the expiration date d43 of the medicine filled to the vial bottle is earlier than the expiration date d53 of the medicine already receiving in the medicine cassette 1 or earlier for equal to or more than a predetermined period of time, the expiration date d43 is not allowed, and in a case other than that, the expiration date d43 is allowed.

Owing to one of or a combination of both those allowable conditions (OR condition or the like), it is possible to prevent such a problem that an old medicine is supplied.

On the other hand, when, in Step S201, it is determined that the operation is the operation of starting other medicine supply-time processes, by the control portion 109, a predetermined search screen including a screen of inputting medicine search information (an example of the medicine specifying information) used for specifying the medicine to be supplied is displayed on the display/operation portion 108, and the process of inputting the medicine search information through the medicine search screen is executed (S221, example of medicine specifying information input means).

FIG. 7 shows an example of a medicine search screen Pg1.

As shown in FIG. 71 the medicine search screen Pg1 displays, as input interface of the medicine search information used for specifying the medicine, input boxes g1 and g2 to which name information and the medicine code d11 of the medicine are input, respectively, selection menus g3 to g6 to which mode information (such as tablet or capsule) of the medicine, color information, shape information (such as disk shape or spherical shape), dimension (size) information are input by being selected from selections, and the like. Those pieces of medicine search information are pieces of information each corresponding to the mode information d14, the shape information d17, the color information d19, and the dimension information d18 included in the medicine master DB (d1), respectively. That is, each of the medicine search information (an example of the medicine specifying information) which can be input through the display/operation portion 108 and the medicine information in the medicine master DB (d1) includes the name information, the color information, the shape information, and the size information of the medicine and the medicine code for identifying each of the medicines.

When, on the medicine search screen Pg1, the user inputs one or a plurality of pieces of the search information and a search button g7 is then operated, by the control portion 109 and the management computer 200, a medicine candidate extraction/listing process is executed (S222).

Specifically, the input search information (an example of the medicine specifying information) is transmitted from the control portion 109 to the management computer 200, and the searching the medicine master DB (d1) is performed by using the search information as the search key. As a result, the medicine information of each of the candidates for the medicine relevant to the input search information is extracted. In this case, the searching the cassette DB (d2) based on the medicine code d11 included in the extracted medicine information is also performed, and the cassette code d21 corresponding thereto is extracted. Further, the extracted medicine information and the cassette code d21 are transmitted from the management computer 200 to the control portion 109. By the control portion 109, a part of the extracted medicine information of each of the candidates for the medicine are listed (presented) on the display/operation portion 108 (S222, example of medicine information search means).

In a display column g8 in a part of the medicine search screen Pg1 shown in FIG. 7, an example of a list in which the extracted candidates for the medicine are listed by the medicine names d12 and the medicine codes d11.

Next, by the control portion 109, there is executed a medicine selecting process for selecting a piece of the medicine information (medicine name d12 & medicine code d11), from the candidates for the medicine listed in the display column g8 of the medicine search screen Pg1 following the operation by the user on the display/operation portion 108 (S223, example of medicine information selecting means).

In the medicine selecting process, when, as shown in FIG. 7, for example, any of the medicine candidates is selected by a touch panel operation or the like in the list display column g8 for the medicine candidates, by the control portion 109, the other pieces of medicine information (mode information d14, shape information d17, dimension information d18, color information d19, and image based on appearance photograph data d16) corresponding to the selected medicine candidate, and the cassette code d21 corresponding to the medicine cassette 1 receiving the medicine is displayed in a medicine information display column g9.

When, in a state where one of the medicine candidates displayed on the list is selected, a decision button g10 is operated, thereby deciding the selection of the medicine. Note that the ones similar in name or the like of the medicine, which is input, may be extracted/listed as the medicine candidates. Further, there is conceived one having a function by which appearance photograph data obtained by photographing the medicine to be supplied by a digital camera or the like is input (transferred) to the management computer 200 through an intermediation of a predetermined storage medium or communication medium, and by a pattern matching between the input appearance photograph data and the appearance photograph data d16 stored in the medicine master DB (d1), the medicines each having an approximate image are extracted/listed as the medicine candidates.

When the selection of the specific medicine is decided as described above, by the control portion 109, a process of specifying the cassette code d21 (that is, cassette shelf 2) corresponding to the selected medicine (S224) is performed, and the process is then moved to Step S206.

Here, the control portion 109 and the management computer 200 performing the processes of Steps S221 to S224 constitute an example of the container mounting portion specification means for specifying the cassette shelf 2 to which the medicine cassette 1 receiving the medicine corresponding to the information input through the display/operation portion 108 (an example of the medicine specifying information input means).

Next, when the process is shifted from the above-mentioned Step S205 or S224 to Step S206, by the control portion 109, determination is made on whether or not the medicine cassette 1 to which the medicine is recovered is mounted to any of the cassette shelves 2, that is, whether or not the cassette code d21 can be specified with reference to (by searching) the cassette DB (d2) in Step S203 or S224 (S206). In a case where it is determined that the medicine cassette 1 to which the medicine is recovered is not mounted to any of the cassette shelves 2, by the control portion 109, the NDC (d11) specified based on the dispensing history DB (d4) in Step S202, the medicine name d12 which can be specified based on the NDC (d11) and the medicine master DB (d1), information relevant to the medicine selected in Step S223, or the like is displayed through the display/operation portion 108, a notification sound is output from a predetermined speaker (S216), and the medicine supply process then ends.

As a result, the operator can recognize that the medicine cassette 1 to which the medicine is recovered does not exist in the cassette shelf 2. Further, in a case where storage place information of the medicine cassette 1 is set as set contents of the cassette code d21 in the cassette DB (d2), the storage place information is displayed on the display/operation portion 108, thereby making it possible to easily find the medicine cassette 1 to which the medicine is recovered.

On the other hand, in a case where, in Step S206, it is determined that the medicine cassette 1 for the medicine which is supplied is mounted to the cassette shelf 2 in Step S202 or S224 (corresponding to process of container mounting portion specification means), by the control portion 109, the shelf lamp 3 provided to the cassette shelf 2 is brought into a blinking state of a relatively long period (hereinafter, referred to as notification display state), for example (S207, example of notification display control means).

As a result, only by allowing the barcode reader 107 to read the prescription code d31 recorded on the vial bottle, the cassette shelf 2 to which the medicine cassette 1 for receiving the medicine to be recovered is mounted is reported by the shelf lamp 3. Accordingly, of the multiple medicine cassettes 1 (cassette shelves 2), an operation of seeking a recovery destination of the medicine can be made more accurate and more efficient.

Further, even in a case where the medicine to be supplied to the medicine cassette 1 is not put in the container, from which information readable by the information reading means such as the barcode reader 107, is recorded (for example, bare tablet as it is), the cassette shelf 2 to which the medicine is to be supplied can be specified easily and accurately. Specifically, the medicine can be searched with reference to search information including color information, shape information, and size information of the medicine. Accordingly, it is also possible to deal with a case where the name of the medicine or the medicine code is unknown (S221 to S224).

Further, the medicine information includes the appearance photograph data d16, so an appearance photograph which is provided and actual appearance of the medicine can be checked thorough comparison therebetween, thereby making it possible to reliably prevent an erroneous operation in which a wrong medicine is supplied to the medicine cassette 1.

After the shelf lamp 3 is brought into the notification display state as described above, by the control portion 109, the attachment/detachment state of the medicine cassette 1 is monitored by the cassette sensor 101, and whether or not the medicine cassette 1 in the cassette shelf 2 whose shelf lamp 3 is in the notification display state (hereinafter, referred to as correct cassette) is removed, or whether or not the medicine cassette 1 in one of the other cassette shelves 2 (hereinafter, referred to as incorrect cassette) is removed is determined (S209).

Here, in a case where removal of the incorrect cassette is detected, by the control portion 109, the shelf lamp 3 to which the incorrect cassette is mounted is brought into a blinking state of a relatively short period (hereinafter, referred to as warning display state), the predetermined warning buzzer is allowed to output a warning sound (S210, example of container erroneous-removal warning means), and the process then returns to Step S208.

As a result, in a state where the multiple cassette shelves 2 are closely arranged, when the medicine cassette 1 is erroneously removed from one of the other cassette shelves 2 other than the cassette shelf 2 whose shelf lamp is in the notification display state (for example, adjacent cassette 2), the error can be notified through a warning notification.

On the other hand, when, in Step S209, removal of the correct cassette is detected, by the control portion 109, whether or not the medicine supply to the medicine cassette 1 of the cassette shelf 2 whose shelf lamp 3 is in the notification display state is monitored (S211). Here, when completion of the medicine supply is detected, that is reported from the control portion 109 to the management computer 200. In the management computer 200, the remaining amount information d22 in the cassette DB (d2) is updated by being added by a quantity of the medicine supplied (an example of obtaining method is described later) (S212, example of second medicine remaining amount update means), and the shelf lamp 3 is turned off by the control portion 109 (S213). After that, the medicine supply-time process ends.

Here, as the means for obtaining a quantity of the supplied medicine (corresponding to medicine supply amount obtaining means), which is used for the addition of the remaining amount information d22 at the time of dispensing the medicine, there is conceived, for example, one which obtains the dispensed quantity information d42 specified by the prescription code d31 read from the vial bottle in Step S202 and the dispensing history DB (d4), by the management computer 200, or one which requests, by transmitting the same prescription code d31 from the control portion 109 or the management computer 200 to the host computer Y, the prescribed quantity d32 included in the prescription data d3 corresponding to the prescription code d31, thereby obtaining the prescribed quantity d32.

Further, as means for obtaining a quantity of the supplied medicine, which is used for the addition of the remaining amount information d22 in a case other than the time of dispensing the medicine (another case), there is conceived, for example, one which obtains supply amount information by input of the user through the display/operation portion 108.

Further, a method of detecting (determining) completion of the medicine supply is the same as that in the case of detecting the completion of the medicine supply shown in Step S100. Further, in a case of the process at the time of recovery the medicine (case where determination is made such that it is "medicine recovery" in Step S201), it is conceivable that the NDC (d11) or the cassette code d21 is recorded in the medicine cassette 1 as the barcode, and this is read by the barcode reader 107, by using the medicine code d11 specified based on the read information and the medicine code d11 specified by the prescription code d31 read from the vial bottle in Step S202 are compared to each other, and based on the comparison results, whether or not the medicine supply to the correct medicine cassette 1 is determined. In this case, it is conceivable that, for example, when it is determined that both the medicine codes d11 do not coincide with each other, a warning sound is output.

However, there is conceived such a structure that, after the process of Step S213, in a case of the medicine recovery process (case where determination is made such that it is "medicine recovery"), the prescription code d31 read from the vial bottle in Step S202 is transmitted to the management computer 200, and in the management computer 200, an update process for the dispensing history DB (d4) based on the prescription code d31 is performed.

In the update process for the dispensing history database DB (d4), in the dispensing history DB (d4), a processing state of the data is stored correspondingly to each of the prescription codes d3, and the processing state corresponding to the prescription code d31 read by the barcode reader 107 is updated from the initial value, that is, the state where it "has not been handed over" to the state where it "has been handed over". Alternatively, it is also conceivable that the subject piece of data is deleted.

As described above, by updating the processing state in each of pieces of data of the dispensing history DB (d4) in response to the medicine recovery from the vial bottle, the vial bottles to each of which the medicine is recovered (that is, each of the prescriptions for each of the patients) can be managed (referred to) by being distinguished from the ones to which the medicine is not recovered.

In the embodiment described above, there is illustrated an example in which the prescription code d31, which is information for specifying the medicine or the expiration date of the medicine, is recorded on the medicine cassette 1 as the barcode by the label output machine 106, and the recorded information is read by the barcode reader 107. However, this is not obligatory, and, for example, it is also conceivable that the vial bottle (dispensing container) is provided with an IC tag which is a memory from/to which information can be read/written by a wireless signal through application of RFID (Radio Frequency Identification) technology or the like, and as means for recording information on the vial bottle and means for reading the recorded information, a tag writer for writing the information on the IC tag provided to the vial bottle through the wireless signal and a tag reader for reading the written information (stored information) through the wireless signal are adopted.

Further, in the above-mentioned embodiment, as the information recorded on the vial bottle, there is taken an example in which the prescription code d31 which is recorded also in the related art is recorded. However, this is not obligatory, and for example, it is conceivable that the medicine code d11 used for specifying the medicine, the expiration date information d43 used for specifying the expiration date of the medicine, or the like is recorded.

Further, a structure of various kinds of database described in the above-mentioned embodiment is an example, and other structures of various kinds can be conceived.

Further, in the above-mentioned embodiment, there is described a structure in which the main body device 100 and the management computer 200 are separated from each other. However, there is also conceived a structure in which they are integrated into one body by providing the function of the management computer 200 to the main body device 100.

INDUSTRIAL APPLICABILITY

The present invention can be applied to a medicine dispensing device for filling a medicine of a kind and in an amount corresponding to contents of a medicine prescription for each of the patients from a plurality of medicine receiving containers each receiving a specific medicine into each of predetermined dispensing containers.

BRIEF DESCRIPTION OF THE DRAWINGS

FIG. 6 Diagrams showing structures of various kinds of database and data related to the medicine dispensing device X.

DESCRIPTION OF SYMBOLS

Figure 1:
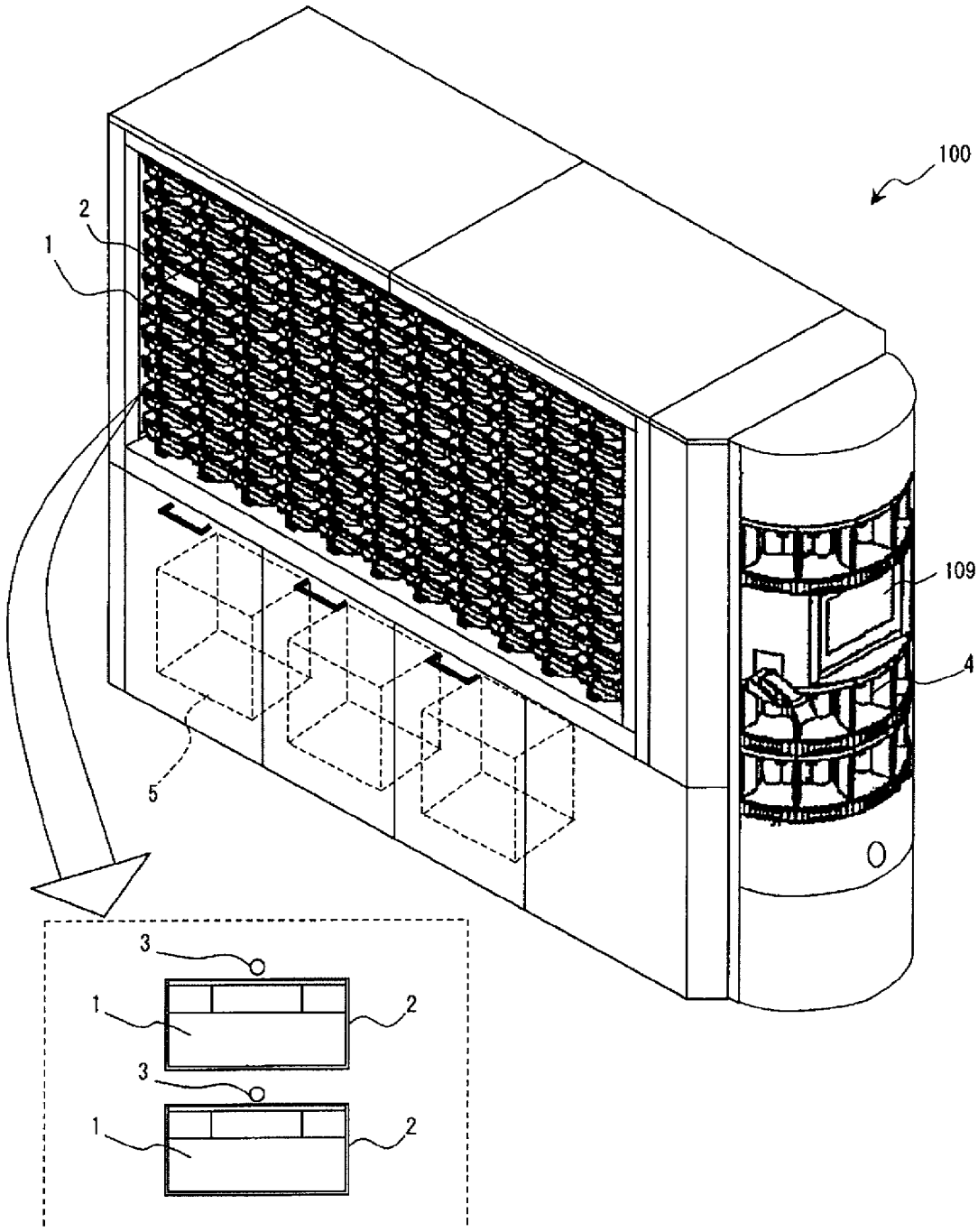
FIG. 1 A perspective view and a partial enlarged view of a medicine dispensing device X main body according to an embodiment of the present invention.
Figure 2:
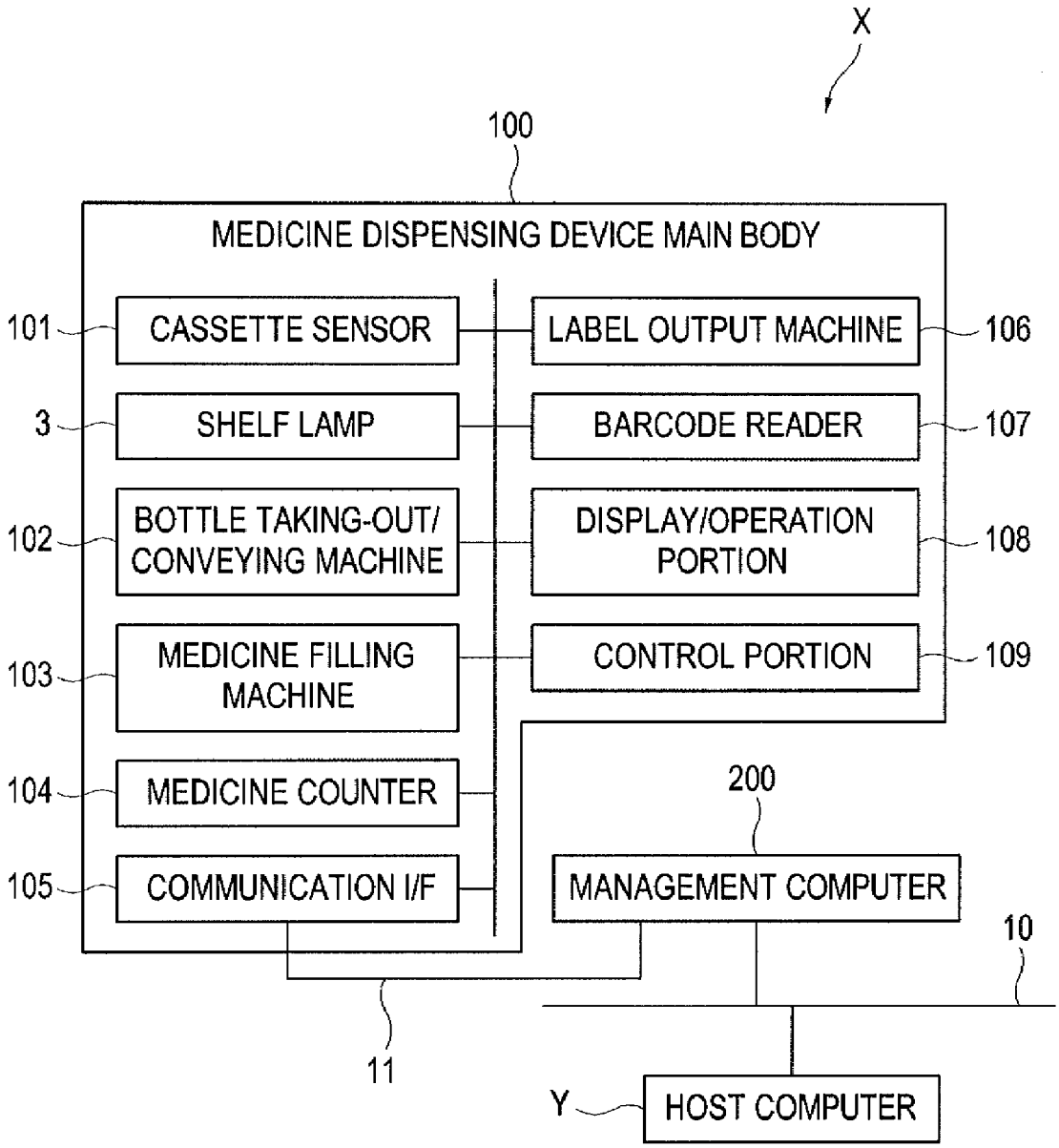
FIG. 2 A block diagram showing a structure of a main portion of the medicine dispensing device X.
Figure 3:
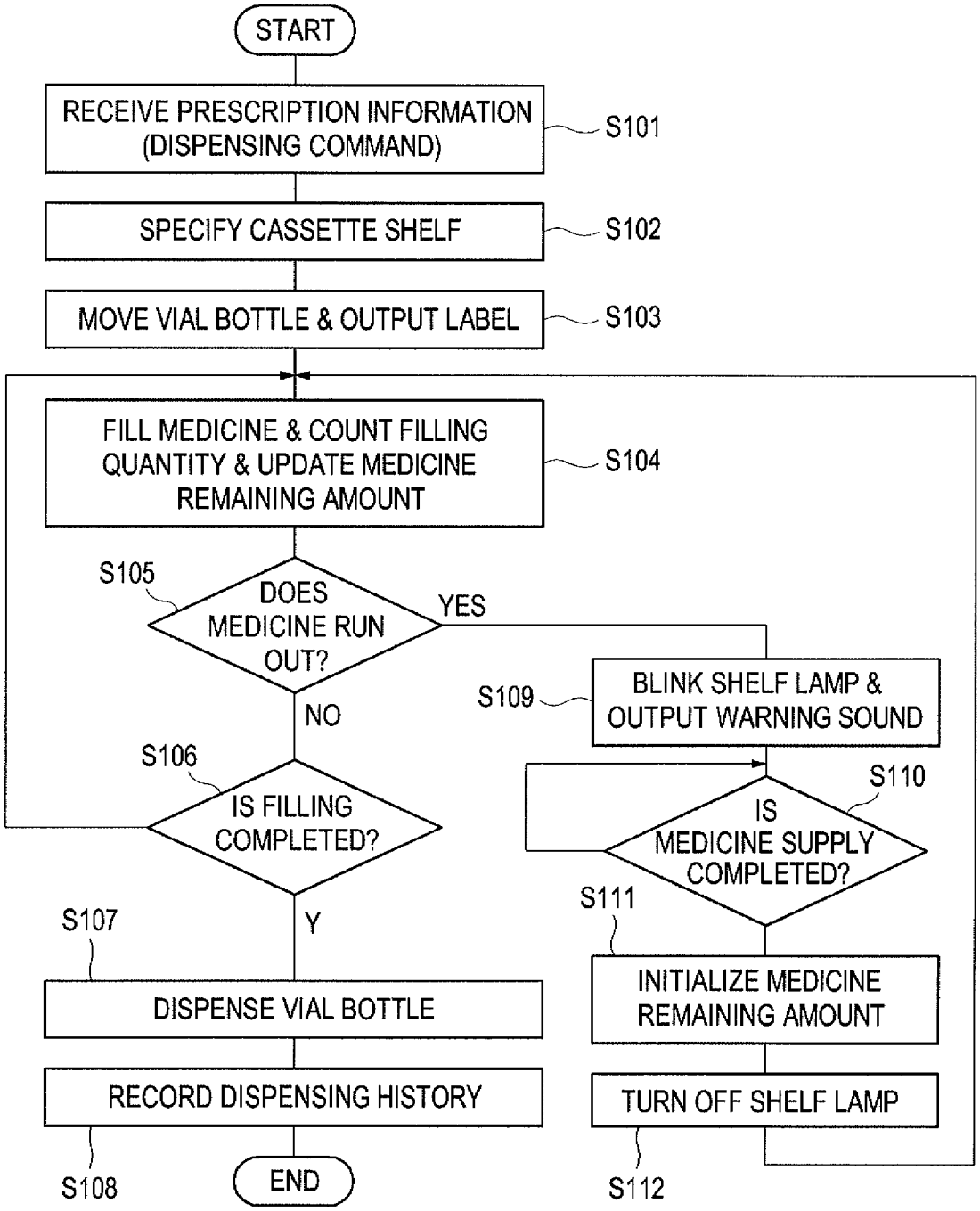
FIG. 3 A flow chart showing a procedure of a medicine dispensing process in the medicine dispensing device X.
Figure 4:
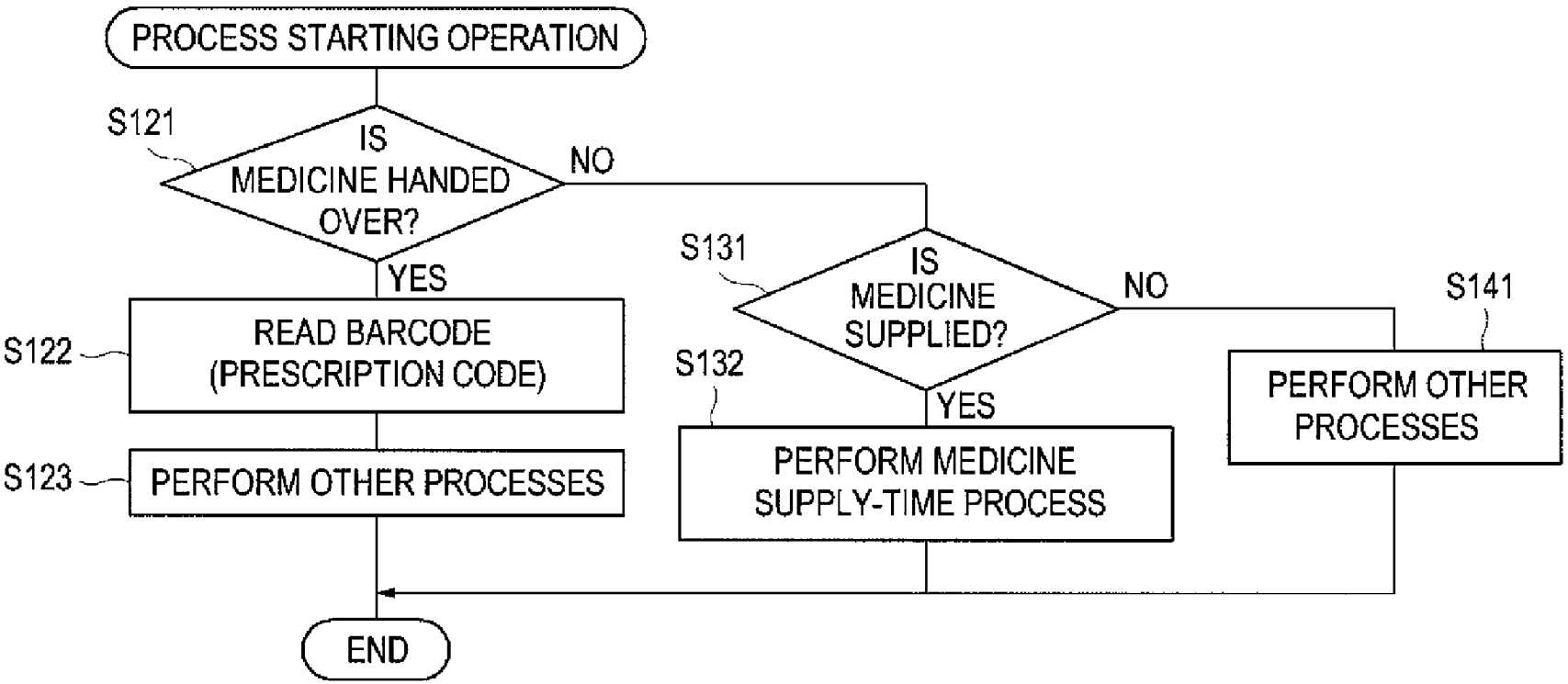
FIG. 4 A flow chart showing a procedure of processes such as medicine handover in the medicine dispensing device X.
Figure 5:
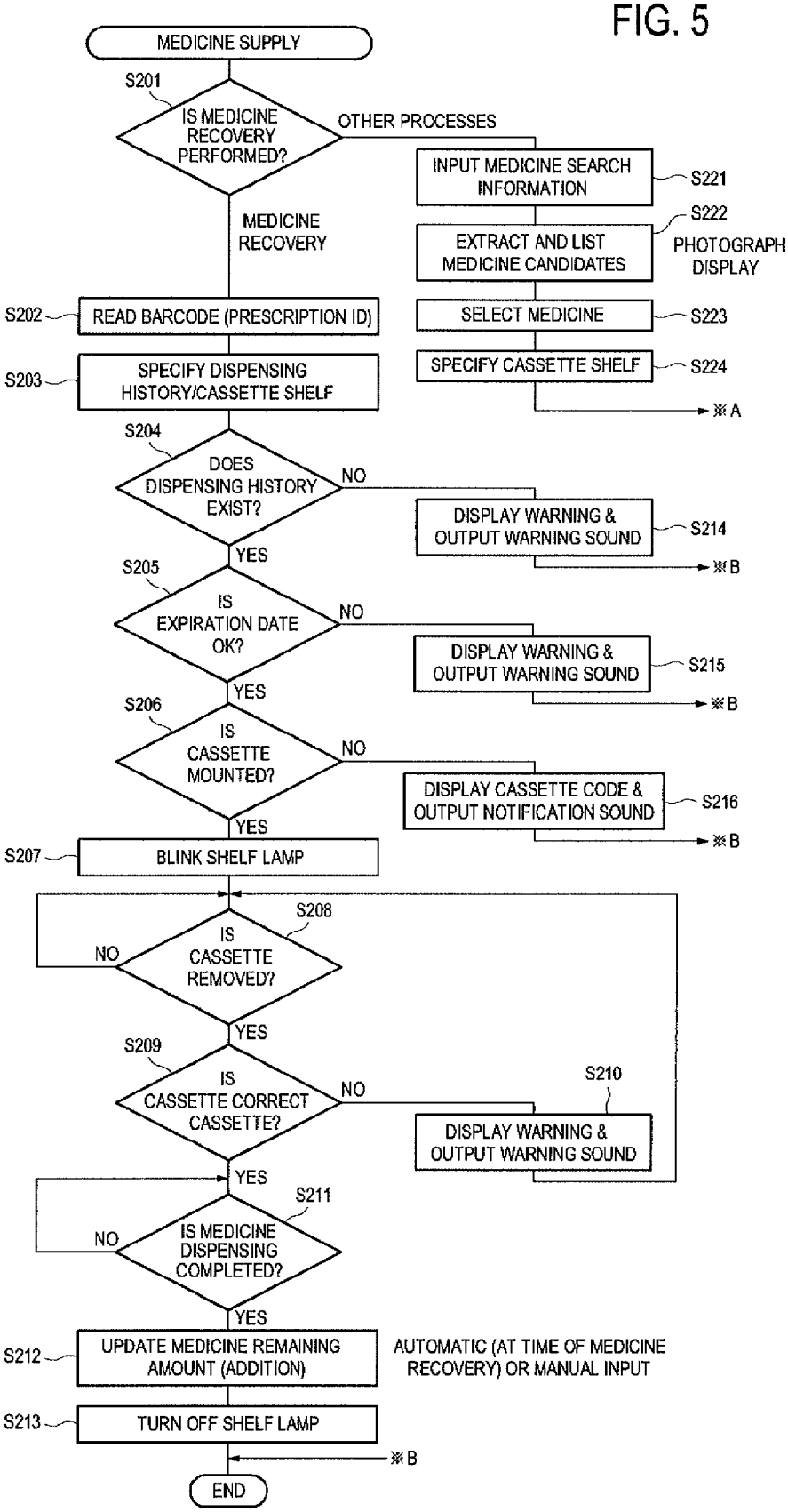
FIG. 5 A flow chart showing a procedure of processes such as the medicine handover in the medicine dispensing device X.
Figure 7:
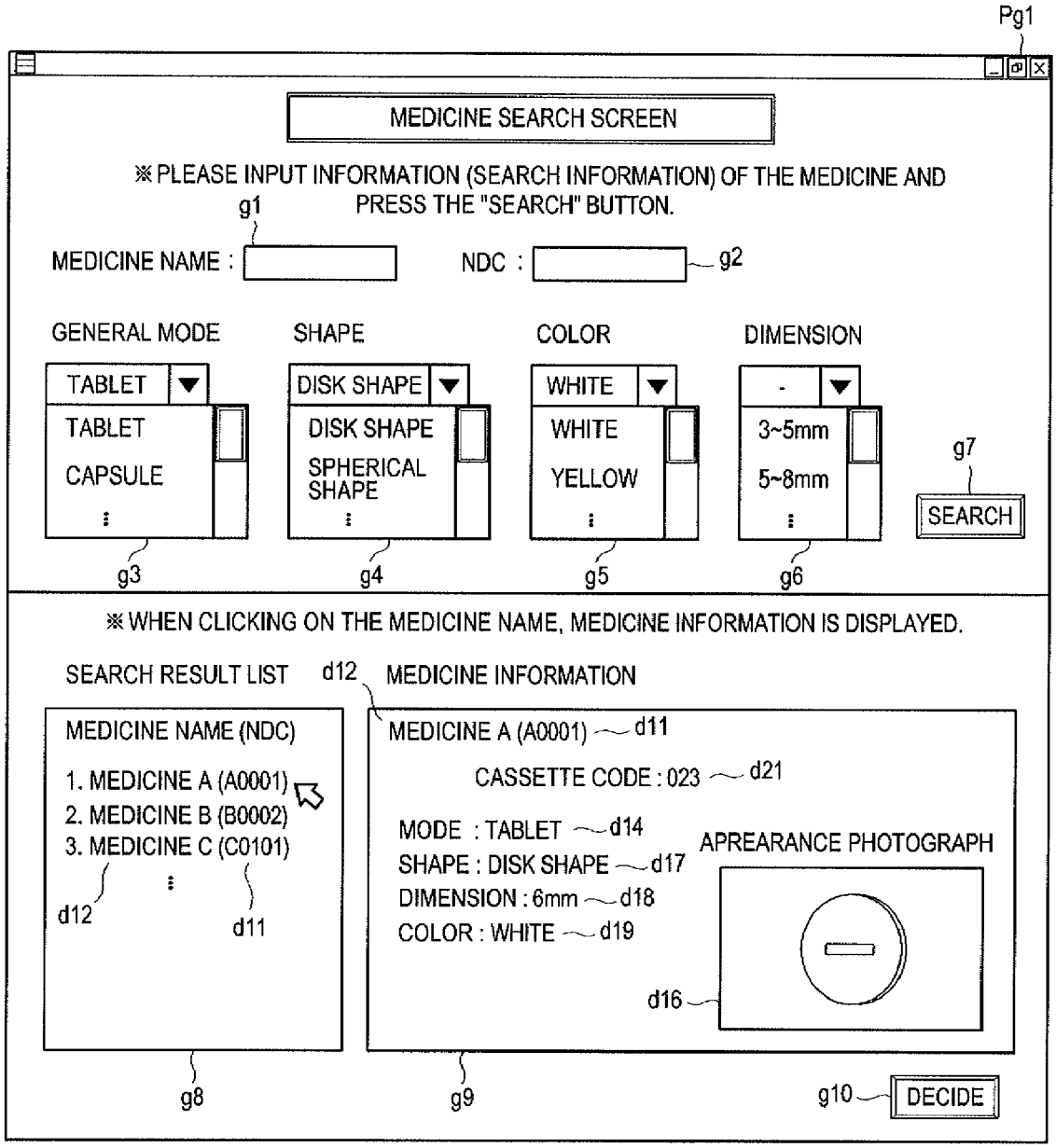
FIG. 7 A view showing a screen example at a time of a medicine supply-time process in the medicine dispensing device X.
Figure 8:
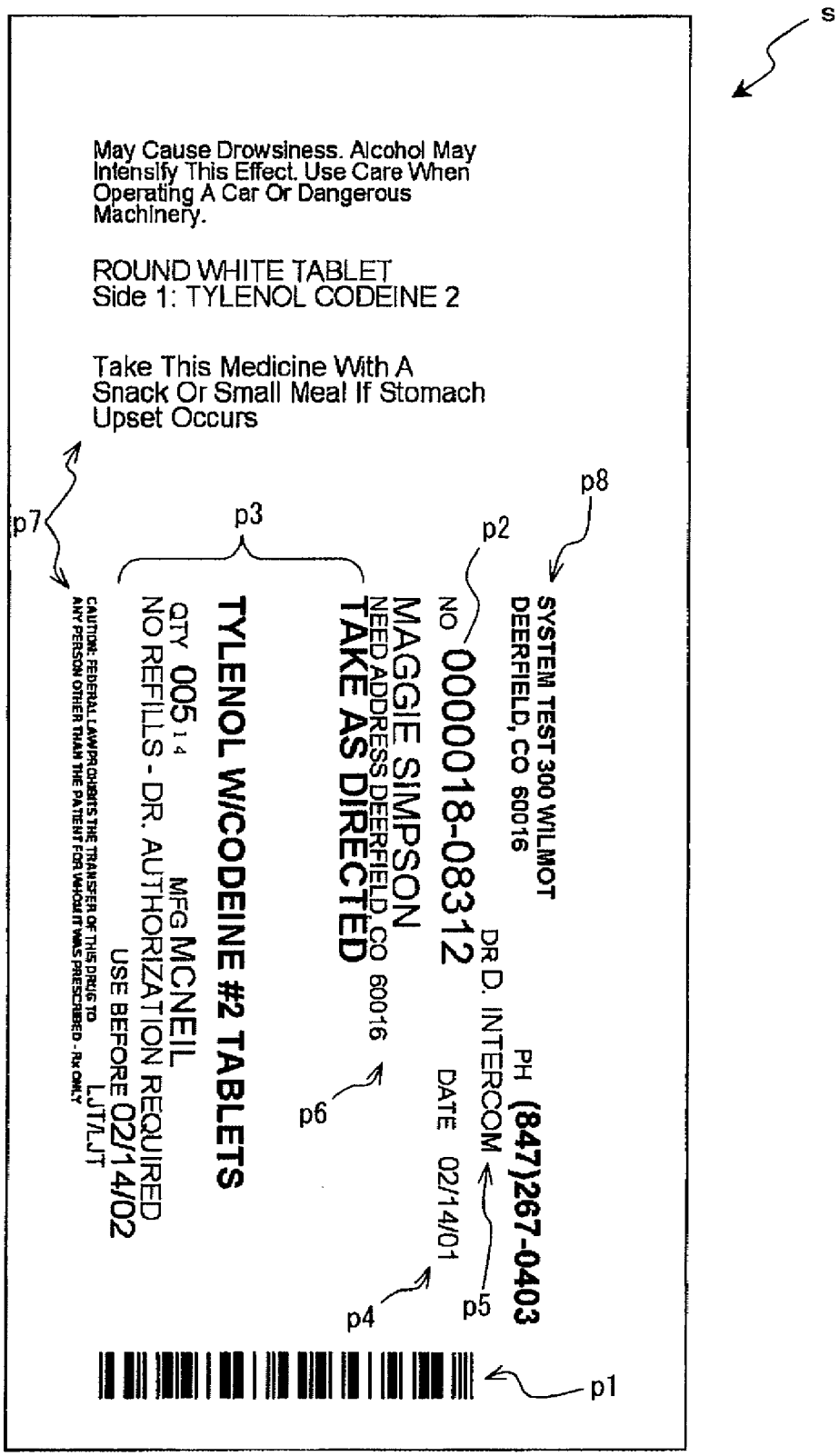
FIG. 8 A view showing an example of a label affixed to a vial bottle by the medicine dispensing device X.

X . . . medicine dispensing device according to embodiment of the present invention
Y . . . host computer
1 . . . medicine cassette
2 . . . cassette shelf
3 . . . shelf lamp
100 . . . medicine dispensing device main body
101 . . . cassette sensor
102 . . . bottle taking-out/conveying machine
103 . . . medicine filling machine
104 . . . medicine counter
105 . . . communication interface
106 . . . label output machine
107 . . . barcode reader
108 . . . display/operation portion
109 . . . control portion
200 . . . management computer
d1 . . . medicine master DB
d2 . . . cassette DB
d3 . . . prescription data d4 . . . dispensing history DB
s . . . label
S101, S102, . . . procedure (step)

The invention claimed is:

1. A medicine recovery method for a medicine dispensing device, the medicine dispensing device including: a plurality of container mounting portions, each including a display portion and having a medicine receiving container mounted thereto; means for filling a dispensing container with a medicine from the medicine receiving container to the dispensing container in an amount corresponding to contents of a prescription; and means for storing dispensing history information including prescription identification information corresponding to the medicine transferred from the medicine receiving containers to the dispensing container, the medicine recovery method recovering the medicine received in the dispensing container and returning the medicine to the medicine receiving container, the medicine recovery method comprising:

reading medicine specifying information from medicine prescription information recorded on the dispensing container;

specifying the container mounting portion to which the medicine receiving container for receiving the medicine received in the dispensing container is mounted based on the medicine specifying information and the dispensing history information;

bringing the display portion provided in the specified container mounting portion into a notification display state; and recovering the medicine received in the dispensing container to the medicine receiving container mounted to the specified container mounting portion.

2. The medicine recovery method of claim 1, wherein the step of specifying the container mounting portion includes ending a medicine supply process when the dispensing history information does not exist in the means for storing dispensing history information.

3. The medicine recovery method of claim 1, further comprising reading expiration date information of the medicine in the dispensing container from the medicine prescription information after the step of reading the medicine specifying information, wherein the step of recovering is performed only when the expiration date information matches predetermined allowable conditions.

4. The medicine recovery method of claim 1, further comprising reading expiration date information of the medicine in the dispensing container from the medicine prescription information after the step of reading the medicine specifying information, wherein a medicine supply process ends when the expiration date information does not match predetermined allowable conditions.

5. The medicine recovery method of claim 1, further comprising generating a warning when one of the plurality of medicine receiving containers that is not mounted to the container mounting portion specified in said step of specifying the container mounting portion is detected as being removed from its respective mounting portion.

6. The medicine recovery method of claim 1, further comprising:

obtaining a supply amount of the medicine recovered to the medicine receiving container; and updating a remaining amount information of the medicine in the medicine receiving container by addition of the obtained supply amount after the medicine is supplied to the medicine receiving container.

7. A medicine supply method for supplying medicine to medicine receiving containers, the method comprising:

providing a medicine dispensing device, the medicine dispensing device including a plurality of container mounting portions, each including a display portion and having a medicine receiving container mounted thereto; means for dispensing a medicine from the medicine receiving container to a dispensing container according to a prescription; and means for storing dispensing history information including prescription identification information corresponding to the medicine transferred from the medicine receiving containers to the dispensing container, the medicine dispensing device being configured to execute instructions configured on a tangible medium, the instructions comprising:

receiving medicine specifying information that specifies a medicine to be supplied to the medicine receiving container;

specifying the container mounting portion to which the medicine receiving container for receiving a medicine received in a dispensing container is mounted based on the received medicine specifying information and the dispensing history information;

bringing the display portion into a notification display state; and supplying the medicine to the medicine receiving container with the display portion brought into the notification display state.

8. The medicine supply method of claim 7, wherein the step of specifying the container mounting portion includes selecting one piece of medicine information from candidates for medicine information, the candidates for medicine information being searched based on medicine information received by the medicine dispensing device.

9. The medicine supply method of claim 7, wherein the instructions configured on the tangible medium further comprise generating a warning when one of the plurality of medicine receiving containers that is not mounted to the container mounting portion specified in the step of specifying the container mounting portion is detected as being removed from its respective mounting portion.

10. The medicine supply method of claim 7, wherein the instructions configured on the tangible medium further comprise:

obtaining a supply amount of the medicine supplied to the medicine receiving container; and updating a remaining amount information of the medicine in the medicine receiving container by addition of the obtained supply amount after the medicine is supplied to the medicine receiving container.

11. A medicine dispensing system comprising:

a plurality of container mounting portions;

a plurality of medicine receiving containers, each mounted to a corresponding one of the plurality of medicine receiving containers;

a plurality of display portions, each corresponding to a respective one of the plurality of container mounting portions; and a medicine dispensing device adapted to dispense a medicine in a predetermined amount from a selected one of the plurality of medicine receiving containers to a dispensing container, the medicine dispensing device comprising:

an input device for receiving information identifying the medicine, the input device comprising means for reading information disposed on the dispensing container;

a specification device adapted to identify a respective one of the plurality of container mounting portions to which the medicine receiving container corresponding to the medicine is mounted and to place the display portion associated with the respective mounting portion into a notification display state; and a medicine filling device adapted to transfer a medicine from a selected one of the plurality of medicine receiving containers to the dispensing container in a predetermined amount based on a prescription, the medicine dispensing system further comprising:

means for storing information from the prescription and for storing information about medicines received by the medicine dispensing device; and means for accumulating and storing dispensing history information to the means for storing information, the dispensing history information including prescription identification information corresponding to the medicine transferred from the selected one of the plurality of medicine receiving containers to the dispensing container, the dispensing history information including at least a portion of the information from the prescription and the information about medicines received by the medicine dispensing device, wherein the specification device is adapted to identify the respective one of the plurality of container mounting portions based on the information from the prescription, the information about medicines received by the medicine dispensing device and the dispensing history information.

12. The medicine dispensing system of claim 11, further comprising:

means for storing a plurality of expiration dates, each of the plurality of expiration dates corresponding to a respective expiration date of one of the plurality of medicines stored in the dispensing containers;

means for reading the expiration date of the plurality of medicines from the means for storing the plurality of expiration dates; and means for issuing a warning when the expiration date of one of the plurality of medicines and a current date and time satisfies a predetermined critereon.

13. The medicine dispensing system of claim 11, further comprising:

means for designating the medicine container of a respective container mounting portion to receive medicines corresponding to medicine and reception correspondence information;

means for selecting candidate medicine receiving containers that correspond to the medicine and reception correspondence information and for presenting the candidate medicine receiving containers; and means for choosing a selected one of the candidate medicine receiving containers, wherein the specification device is adapted to identify the respective one of the plurality of container mounting portions corresponding to the selected one of the candidate medicine receiving containers.

14. The medicine dispensing system of claim 13, wherein the information identifying the medicine and the medicine and reception correspondence information include one or more of a name of the medicine, a color of the medicine, a shape of the medicine, a size of the medicine, medicine identification information that identifies each of the medicines, and a photograph of the appearance of the medicine.

15. The medicine dispensing device of claim 11, further comprising:

means for updating a remaining amount of the medicine in each of the plurality of medicine receiving containers; and means for obtaining an amount of medicine to be supplied to the selected one of the plurality of medicine receiving containers.

16. The medicine dispensing device of claim 11, further comprising:

means for detecting an attachment and detachment state between each of the plurality of container mounting portions and the corresponding one of the plurality of medicine receiving containers; and means for notifying when one of the medicine receiving containers other than the selected one of the plurality of medicine receiving containers is detected by the container attachment and means for detecting an attachment and detachment state as being detached from its respective mounting portion.

17. A medicine dispensing device, comprising:

a plurality of medicine receiving containers;

a display portion displaying portions to which the medicine receiving containers are mounted respectively;

means for filling a medicine of a kind and in an amount corresponding to contents of a prescription from the medicine receiving container to a dispensing container;

means for inputting medicine specifying information used for specifying the medicine;

means for specifying the container mounting portion to which the medicine receiving container receiving the medicine corresponding to the medicine specifying information input through the means for inputting medicine specifying information is mounted; and means for bringing the display portion displaying the container mounting portion specified by the means for specifying the container mounting portion into a notification display state, wherein the medicine dispensing device is configured to perform a medicine recovery process for recovering the medicine from the dispensing container to an original medicine receiving container.

18. The medicine dispensing device of claim 17, wherein the dispensing container is a vial bottle.

19. A medicine dispensing device, comprising:

a plurality of medicine receiving containers;

a display portion displaying portions to which the medicine receiving containers are mounted respectively;

means for filling a medicine of a kind and in an amount corresponding to contents of a prescription from the medicine receiving container to a dispensing container;

means for inputting medicine specifying information used for specifying the medicine;

means for specifying the container mounting portion to which the medicine receiving container receiving the medicine corresponding to the medicine specifying information input through the means for inputting medicine specifying information is mounted; and means for bringing the display portion displaying the container mounting portion specified by the means for specifying the container mounting portion into a notification display state, wherein the medicine dispensing device is configured to perform a medicine supply process for supplying a medicine that is not received in the dispensing container to the medicine receiving container receiving the same medicine as the medicine that is not received in the dispensing container.

20. The medicine dispensing device of claim 19, wherein the dispensing container is a vial bottle.

21. The method of claim 1, wherein the dispensing container of the medicine dispensing device is a vial bottle.

22. The method of claim 7, wherein the dispensing container provided in the step of providing a medicine dispensing device is a vial bottle.

23. The medicine dispensing system of claim 11, wherein the dispensing container is a vial bottle.

* * * * *

UNITED STATES PATENT AND TRADEMARK OFFICE

CERTIFICATE OF CORRECTION

PATENT NO. : 8,295,977 B2
APPLICATION NO. : 12/064740
DATED : October 23, 2012
INVENTOR(S) : Yuyama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 679 days.

Signed and Sealed this
Tenth Day of June, 2014

Michelle K. Lee

Michelle K. Lee
*Deputy Director of the United States Patent and Trademark Office*